US007108557B2

(12) United States Patent
Kikuchi et al.

(10) Patent No.: US 7,108,557 B2
(45) Date of Patent: Sep. 19, 2006

(54) INTEGRATED CIRCUIT (IC) CARD CONNECTOR INCLUDING A MOVABLE BRAKING PIECE

(75) Inventors: Kouji Kikuchi, Tokyo (JP); Katsuhide Higuchi, Guang Dong Sheng (CN); Masaaki Ooya, Yokohama (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 11/081,662

(22) Filed: Mar. 17, 2005

(65) Prior Publication Data

US 2005/0208804 A1 Sep. 22, 2005

(30) Foreign Application Priority Data

Mar. 18, 2004 (JP) ..... 2004-078912
Dec. 28, 2004 (JP) ..... 2004-381505

(51) Int. Cl.
*H01R 24/00* (2006.01)

(52) U.S. Cl. ..... 439/630; 439/159; 439/946

(58) Field of Classification Search ..... 439/630, 439/159, 946, 633, 945
See application file for complete search history.

(56) References Cited

U.S. PATENT DOCUMENTS 3,823,367 A 7/1974 Kaye et al.
3,932,016 A 1/1976 Ammenheuser
4,780,603 A 10/1988 Hamada
4,864,116 A 9/1989 Banjo et al.
5,036,430 A 7/1991 Hills
5,198,645 A 3/1993 Martin et al.
5,207,598 A 5/1993 Yamada et al.
5,320,552 A * 6/1994 Reichardt et al. ..... 439/331
5,374,198 A 12/1994 Nagata
5,456,610 A * 10/1995 Banakis et al. ..... 439/157
5,511,986 A * 4/1996 Casey et al. ..... 439/188
5,518,986 A 5/1996 Winston
5,581,127 A * 12/1996 Shinohara ..... 257/679
5,668,365 A 9/1997 Ito et al.
5,695,351 A * 12/1997 Kimura et al. ..... 439/159
5,718,609 A * 2/1998 Braun et al. ..... 439/630
5,872,353 A 2/1999 Reichardt et al.

(Continued)

FOREIGN PATENT DOCUMENTS

EP 0 284 431 A2 9/1988

(Continued)

OTHER PUBLICATIONS

International search Report for Application No. PCT/JP00/007762, dated Feb. 6, 2001 from the European Patent Office.

(Continued)

*Primary Examiner*—Hae Moon Hyeon
(74) *Attorney, Agent, or Firm*—Finnegan, Henderson, Farabow, Garrett & Dunner, LLP

(57) ABSTRACT

An Integrated Circuit (IC) card connector includes a housing member, an ejection mechanism, and a plurality of braking pieces. The housing member includes an accommodation portion for selectively accommodating an IC card. When the ejection mechanism ejects the IC card from the accommodation portion, an end of at least one of the plurality of braking pieces contacts a movable part of the ejection mechanism. After contacting the movable part of the ejection mechanism, the end of the at least one braking piece retreats. Thus, the braking piece decelerates the ejection speed of the IC card and avoids the undesirable jumping-out of the IC card. Embodiments consistent with the invention may also include an improper insertion piece provided in the housing member.

5 Claims, 26 Drawing Sheets

U.S. PATENT DOCUMENTS

| | | | | | |
|---|---|---|---|---|---|
| 5,967,811 | A | * | 10/1999 | Yamamoto et al. | 439/159 |
| 6,068,500 | A | * | 5/2000 | Kantner | 439/218 |
| 6,068,516 | A | * | 5/2000 | Chang | 439/633 |
| 6,083,018 | A | * | 7/2000 | Hara et al. | 439/159 |
| 6,089,919 | A | | 7/2000 | Nishioka | |
| 6,126,486 | A | * | 10/2000 | Chang | 439/630 |
| 6,129,571 | A | * | 10/2000 | Ikemoto | 439/260 |
| 6,155,853 | A | * | 12/2000 | Kajiura | 439/159 |
| 6,213,785 | B1 | * | 4/2001 | Nishio et al. | 439/64 |
| 6,231,360 | B1 | * | 5/2001 | Horie | 439/159 |
| 6,234,845 | B1 | * | 5/2001 | Hakozaki | 439/633 |
| 6,270,365 | B1 | * | 8/2001 | Nishioka | 439/159 |
| 6,361,339 | B1 | * | 3/2002 | Zhang et al. | 439/160 |
| 6,364,674 | B1 | * | 4/2002 | Kajiura | 439/159 |
| 6,394,827 | B1 | * | 5/2002 | Nogami | 439/159 |
| 6,478,630 | B1 | * | 11/2002 | Hsu | 439/680 |
| 6,482,030 | B1 | * | 11/2002 | Kuo | 439/541.5 |
| 6,540,560 | B1 | * | 4/2003 | Ito et al. | 439/663 |
| 6,607,404 | B1 | | 8/2003 | Ito et al. | |
| 6,609,919 | B1 | * | 8/2003 | Ito et al. | 439/159 |
| 6,699,061 | B1 | | 3/2004 | Abe et al. | |
| 6,729,892 | B1 | | 5/2004 | Takada et al. | |
| 6,851,959 | B1 | * | 2/2005 | Ooya et al. | 439/159 |
| 6,905,369 | B1 | * | 6/2005 | Nakai et al. | 439/630 |

FOREIGN PATENT DOCUMENTS

| | | | |
|---|---|---|---|
| JP | 63-133473 | | 6/1988 |
| JP | 63-133473 | A | 6/1988 |
| JP | 01-168978 | A | 7/1989 |
| JP | 1-168978 | | 11/1989 |
| JP | 06-162281 | A | 6/1990 |
| JP | 2-187887 | | 7/1990 |
| JP | 02-187887 | A | 7/1990 |
| JP | 05-21118 | A | 1/1993 |
| JP | 05-502746 | | 5/1993 |
| JP | 05-502746 | A | 5/1993 |
| JP | 06-044052 | | 2/1994 |
| JP | 06-044052 | A | 2/1994 |
| JP | 06-162281 | | 6/1994 |
| JP | 07-153524 | A | 6/1995 |
| JP | 07153524 | | 6/1995 |
| JP | 7-335321 | | 12/1995 |
| JP | 07-335321 | A | 12/1995 |
| JP | 8-315081 | | 11/1996 |
| JP | 08-315081 | A | 11/1996 |
| JP | 09-007694 | A | 1/1997 |
| JP | 09007694 | | 1/1997 |
| JP | 10-091729 | A | 4/1998 |
| JP | 10091729 | | 4/1998 |
| JP | 10-187896 | | 7/1998 |
| JP | 10-187896 | A | 7/1998 |
| JP | 10-240871 | A | 9/1998 |
| JP | 10240871 | | 9/1998 |
| JP | 11-053503 | | 2/1999 |
| JP | 11-053503 | A | 2/1999 |
| JP | 11-316110 | | 11/1999 |
| JP | 11-316110 | A | 11/1999 |
| JP | 2000-277200 | | 6/2000 |
| JP | 2000-251024 | A | 9/2000 |
| JP | 2000-251025 | A | 9/2000 |
| JP | 2000-277200 | A | 10/2000 |
| JP | 2001-135385 | A | 5/2001 |
| JP | 2001-160458 | A | 6/2001 |
| JP | 2001-195546 | A | 7/2001 |
| JP | 2001-203039 | A | 7/2001 |
| JP | 3306395 | | 5/2002 |
| JP | 3429267 | | 5/2003 |

OTHER PUBLICATIONS

Office Action in co-pending U.S. Appl. No. 09/703,682, filed Dec. 20, 2001, which issued as U.S. Patent No. 6,607,404.

Office Action in co-pending U.S. Appl. No. 09/703,669, filed Jan. 15, 2002, which issued as U.S. Patent No. 6,607,404.

Office Action in co-pending U.S. Appl. No. 09/703,669, filed Jun. 22, 2001, which issued as U.S. Patent No. 6,607,404.

Office Action in co-pending U.S. Appl. No. 09/703,682, filed Jul. 10, 2001, which issued as U.S. Patent No. 6,540,560.

Office Action in co-pending U.S. Appl. No. 09/890,637, filed Dec. 17, 2002, which issued as U.S. Patent No. 6,699,061.

Office Action in co-pending U.S. Appl. No. 09/890,637, filed Jul. 26, 2002, which issued as U.S. Patent No. 6,699,061.

Office Action in co-pending U.S. Appl. No. 09/890,637, filed May 29, 2003, which issued as U.S. Patent No. 6,699,061.

Office Action in co-pending U.S. Appl. No. 10/212,869, filed Apr. 9, 2004, which issued as U.S. Patent No. 6,851959,061.

Office Action in co-pending U.S. Appl. No. 10/212,869, filed Jun. 13, 2003, which issued as U.S. Patent No. 6,851959,061.

* cited by examiner

INTEGRATED CIRCUIT (IC) CARD CONNECTOR INCLUDING A MOVABLE BRAKING PIECE

This application claims priority from Japanese Patent Application Nos. 2004-078912 filed Mar. 18, 2004 and 2004-381505 filed Dec. 28, 2004, which are incorporated hereinto by reference.

BACKGROUND OF THE INVENTION

1. Field of the Invention

The present invention relates to an Integrated Circuit (IC) card connector having a braking piece for braking the election of the IC card ejected by an ejection mechanism.

2. Description of the Related Art

An IC card connector is provided in a portion for accommodating a vertically oriented IC card with an ejection mechanism for loading/unloading the IC card, for example, as disclosed in Japanese Patent No. 3,306,395 and U.S. Pat. No. 6,699,061.

Another ejection mechanism provided in the IC card connector has been put into practice as disclosed in Japanese Patent No. 3,429,267 and U.S. Pat. No. 6,729,892. That is, instead of an ejector member described in the above-mentioned U.S. Pat. No. 3,306,395 and No. 6,699,061, the vertically oriented IC card longer in the longitudinal direction itself is pushed against a biasing force of a coil spring in the loading/unloading direction and held in the accommodation portion by its ejector member. On the other hand, if the loaded IC card is further pushed in the same direction, the ejector member is moved in the card-ejecting direction due to the recovery force of the coil spring to eject the IC card from the accommodation portion.

Such an ejection mechanism comprises, for example as main components, an ejector member, an ejector member control section for controlling the operation for selectively holding or releasing the ejector member, and a coil spring disposed between a side wall defining a card accommodation portion and the ejector member, for biasing the ejector member in the ejecting direction of the IC card.

In this structure, when the IC card is ejected by the ejection mechanism, the ejection speed of the IC card is provided in accordance with an elastic force (a spring constant) of the coil spring.

Accordingly, when the operator removes the IC card from the accommodation portion, there is a risk in that directly after the operator has pushed the IC card twice in the same direction, if his finger is quickly released from an end of the IC card, the IC card may abruptly jump out from the card accommodation portion due to the elastic force of the coil spring.

To avoid such undesirable jumping-out of the IC card, for example as disclosed in Japanese Patent No. 3,306,395, there is a proposal in that a front end of an elastically deformable braking piece is brought into contact with a lower surface of the IC card to generate a frictional force for preventing the IC card from jumping out.

SUMMARY OF THE INVENTION

As mentioned above, in the IC card connector in which the ejection speed of the IC card is provided in accordance with the elastic force (the spring constant) of the coil spring, it is necessary for avoiding undesirable jumping-out of the IC card when ejecting the IC card as smaller size IC cards are used to provide the above-mentioned braking piece as well as to change the design so that the spring constant of the coil spring becomes smaller.

However, if the design is changed so that the spring constant of the coil spring becomes smaller, ejection defects of the IC card may be caused. Moreover, it is not easy to strictly control the spring constant of the coil spring in production by taking the individual variance between the respective coil springs into consideration. Accordingly, the conventional countermeasures are not reliable means for smoothly ejecting the IC card while avoiding the undesirable jumping-out of the IC card accompanied with the downsizing thereof.

In consideration of the problem mentioned above, an object of the present invention is to provide an IC card connector having a braking piece for braking the IC card ejected by an ejection mechanism from the IC card connector so that the undesirable jumping-out of the IC card accompanied with the downsizing thereof is assuredly avoidable.

To achieve the above-mentioned object, the inventive IC card connector includes a housing member having an accommodation portion for selectively accommodating an IC card and a contact terminal to be electrically connected to the IC card, an ejection m mechanism for selectively ejecting the IC card outside from the accommodation portion of the housing member, and a plurality of braking pieces for braking the ejection of the IC card in a state wherein the IC card is ready for being ejected from the accommodation portion of the housing member by the ejection mechanism, characterized in that an end of one of the plurality of braking pieces once strikes on a movable part of the ejection mechanism when the IC card is ejected by the ejection mechanism, and thereafter retreats at an original position.

As apparent from the above description, according to the inventive IC card connector, the plurality of braking pieces for braking the ejection of the IC card are provided, and when the IC card is ejected by the ejection mechanism, one end of at least one of these braking pieces once strikes on the movable part of the ejection mechanism, and then retreats at the original position, whereby the ejection speed of the IC card is decelerated to assuredly avoid the undesirable jumping-out of the IC card accompanied with the downsizing of the IC card.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 2:
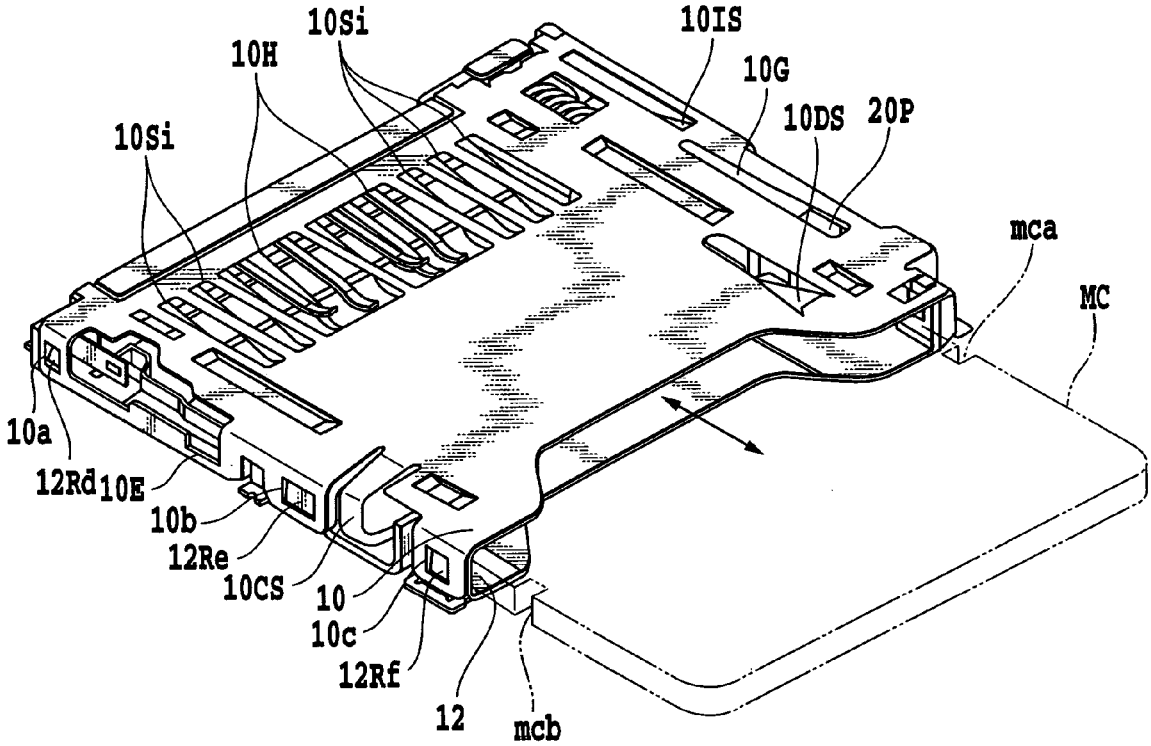
FIG. 2 is a perspective view illustrating a whole appearance of the aspect of the inventive IC card connector.
Figure 3:
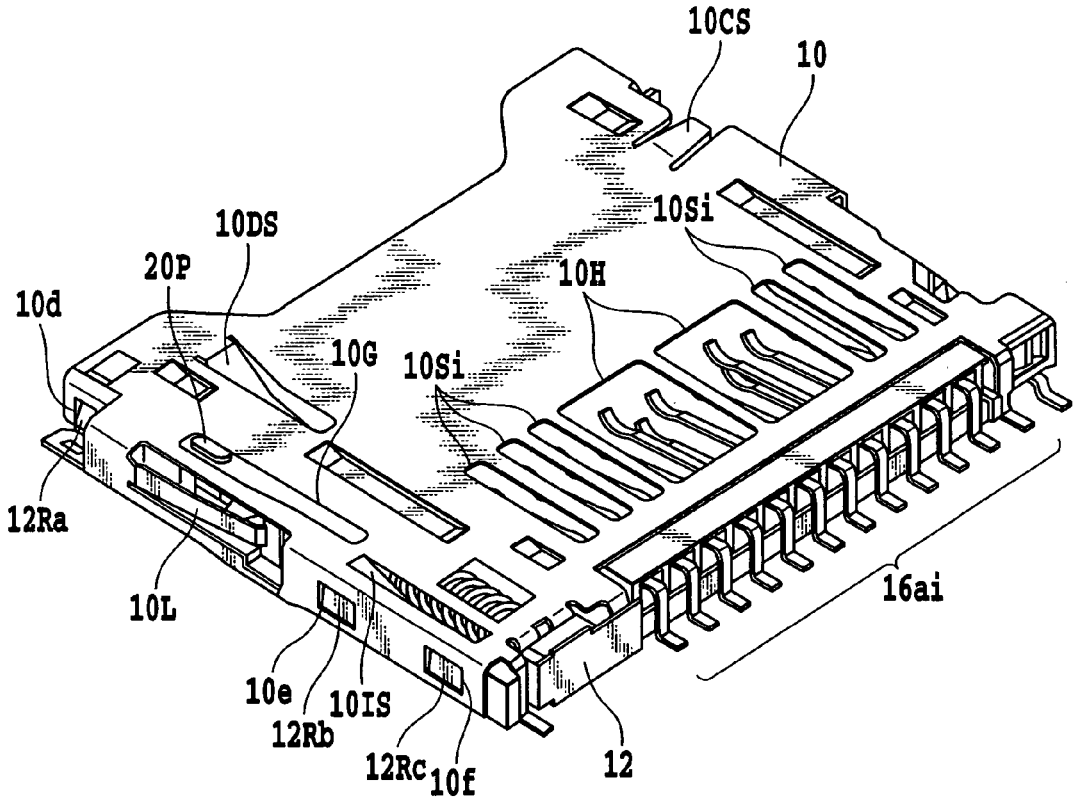
FIG. 3 is a perspective view illustrating a whole appearance of the aspect of the inventive IC card connector.
Figure 4A:
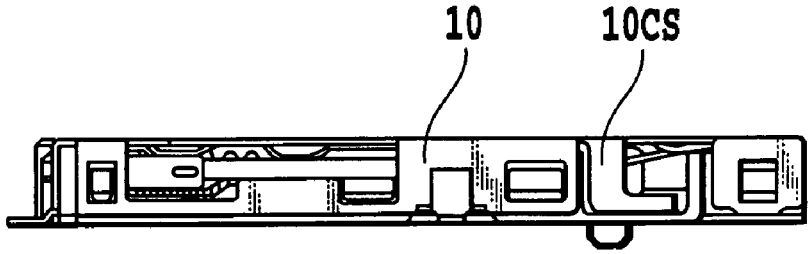
FIG. 4A is a side view of the aspect shown in FIG. 2.
Figure 4B:
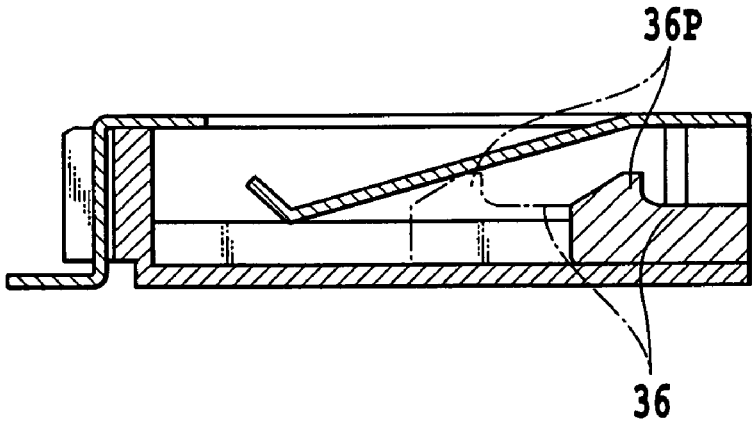
FIG. 4B is a partially sectional view in FIG. 4A.

FIGS. 2 and 3 illustrate an appearance of one embodiment of the IC card connector in accordance with the present invention.

The IC card is disposed in the interior of a predetermined electronic instrument such as a cellular phone, a telephone, PDA, a camera or others.

The IC card connector shown in FIG. 2 is adapted to electrically connect an electrode section of a memory card MC which is an IC card, e.g. such as a MINI-SD CARD (a trade mark) accommodated in an attachable/detachable manner in the direction shown by an arrow in an accommodation portion of the IC connector, with a connecting terminal section of a substrate disposed within a predetermined electronic instrument for inputting/outputting signals. In the platy memory card MC, a plurality of electrode pads are formed on one of surfaces thereof in correspondence to the arrangement of contact terminals described later. Also, on the opposite sides thereof, there are notches mca and mcb described later.

The IC card connector comprises a base member 12 on which a plurality of contact terminals or others are arranged to be electrically connected to the memory card MC accommodated in the card connector, and a cover member 10 forming the accommodation portion for the memory card MC in association with the base member 12.

The cover member 10 of a gate-shaped cross-section is made of a thin metallic sheet. As shown in FIGS. 2 and 3, on one of opposite lateral surfaces of the cover member 10, there are engagement holes 10*a*, 10*b* and 10*c* to be engaged, respectively, with nibs of the base member 12 described later. On the other lateral surface of the cover member 10, there are engagement holes 10*d*, 10*e* and 10*f* to be engaged, respectively, with nibs of the base member 12 described later.

At positions in the vicinity of the engagement holes 10*b*, 10*c* and 10*d*, flange portions soldered, for example, to a wiring board are provided in integral therewith, respectively.

Accordingly, the cover member 10 is secured to the base member 12 by the engagement of the respective engagement holes 10*a*–10*f* with the respective nibs of the base member 12.

As shown in FIG. 3, a pressure spring 10L for supporting a cam lever in an ejection mechanism described later is provided between the engagement holes 10*d* and 10*e* on the other lateral surface of the cover member 10. A proximal end of the elastic pressure spring 10L is formed in integral with the cover member 10.

An opening 10E for communicating the interior of the above-mentioned accommodation portion with outside is provided between the engagement holes 10*a* and 10*b* on the other lateral surface of the cover member 10, as shown in FIG. 2.

As shown in FIG. 2, there are a plurality of slits 10Si and a hole 10H are formed, in correspondence to a group of contact terminals described later, on the upper surface of the cover member 10 coupling the opposite lateral surfaces thereof. Also, an ejector member control piece 10IS is provided adjacent to the slit 10Si on the upper surface.

Figure 1:
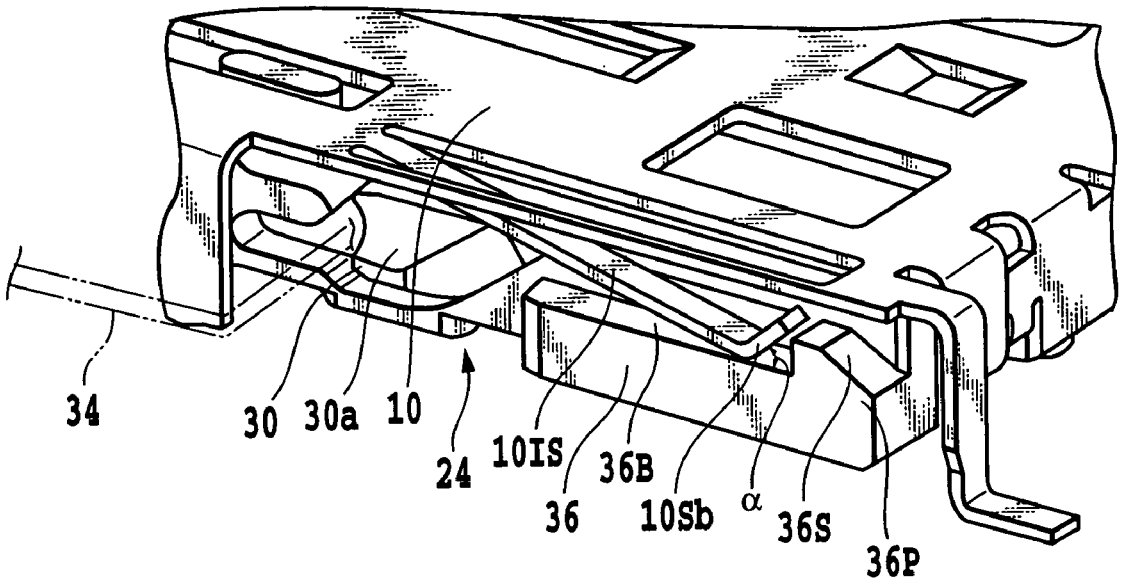
FIG. 1 is an enlarged perspective view of a main part in one aspect of the inventive IC card connector.

As illustrated in FIG. 1 in enlarged dimension, the proximal end of the elastic ejector member control piece 10IS is formed in integral with the cover member 10. The ejector member control piece 10IS is formed, for example, by punching out part of the cover member 10 inward thereof by the press working. Accordingly, at a portion of the upper surface of the cover member 10 corresponding to the ejector member control piece 10IS, an opening is formed. The ejector member control piece 10IS has a bending portion 10*sb* at a distal end thereof for selectively being in sliding contact with the ejector member described later. A distal end of the bending portion 10*sb* elastically displaceable toward the opening intersects a line parallel to a bottom surface of the base member 12, for example, at an angle $\alpha$ ($\alpha$=approximately 45±30 degrees). A shape of the distal end of the bending portion 10*sb* should not be limited to this example, but may be other shapes, such as an approximate arc.

As shown in FIG. 2, an elongate groove 10G is formed in an area adjacent to the ejector member control piece 10IS and extends in the loading or unloading direction of the memory card MC, so that a guide pin 20P of the ejector member 20 described later is inserted therein and moved therethrough. A width of the elongate groove 10G gradually increases toward a side of a card slot.

Figure 7:
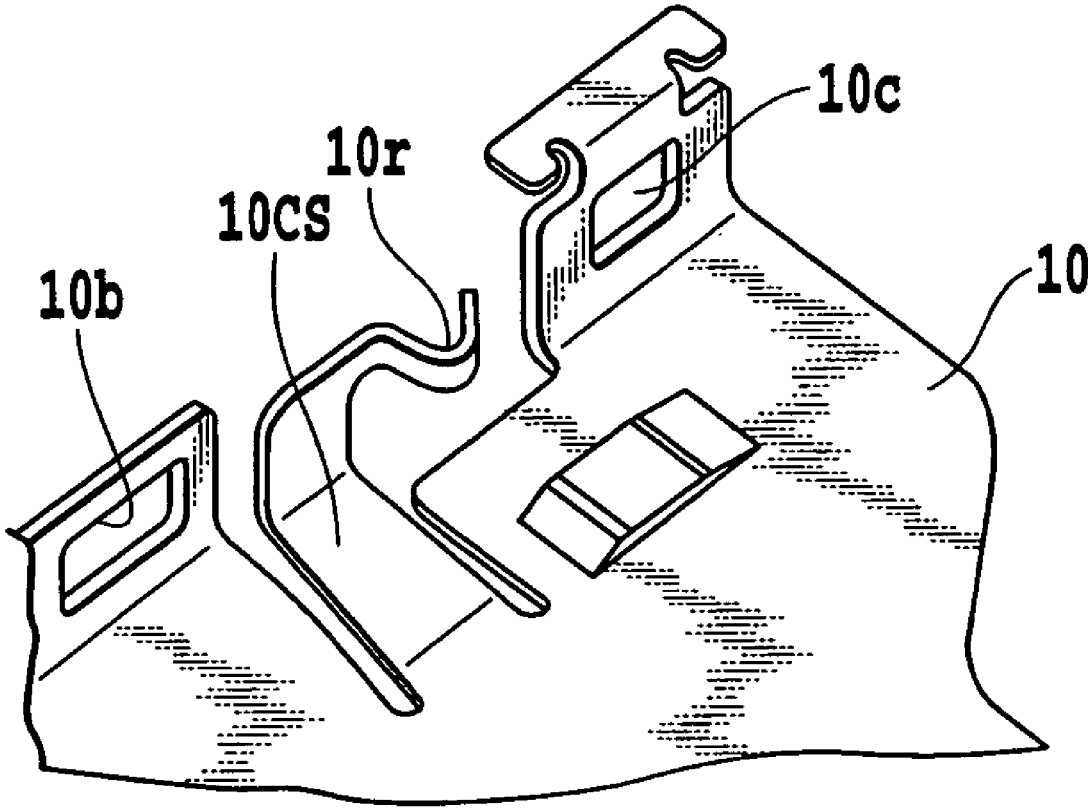
FIG. 7 is a perspective view illustrating a braking piece in the cover member in the aspect shown in FIG. 2.

A first braking piece 10CS is provided on the upper m surface of the cover member 10 between the engagement holes 10*b* and 10*c* adjacent to the opening 10E. As illustrated in FIG. 7 in enlarged dimension, the first braking piece 10CS has an elastically displaceable curved section 10*r*. The curved section 10*r* projects inward of the cover member 10 to selectively engage with a notch mcb of the memory card MC inserted into the accommodation portion.

As shown in FIG. 2, a second braking piece 10DS is provided in part of the upper surface on a side closer to the ejector member control piece 10IS. A proximal end of the second braking piece 10DS is formed in integral with the cover member 10. The second braking piece 10DS is formed by punching out part of the cover member 10 inward thereof by the press working. Accordingly, in a portion of the upper surface of the cover member 10 corresponding to the second braking piece 10DS, an opening is formed. The tip of second braking piece 10DS has an elastically displaceable curved section which is selectively in sliding contact with a surface of the memory card MC.

Figure 5:
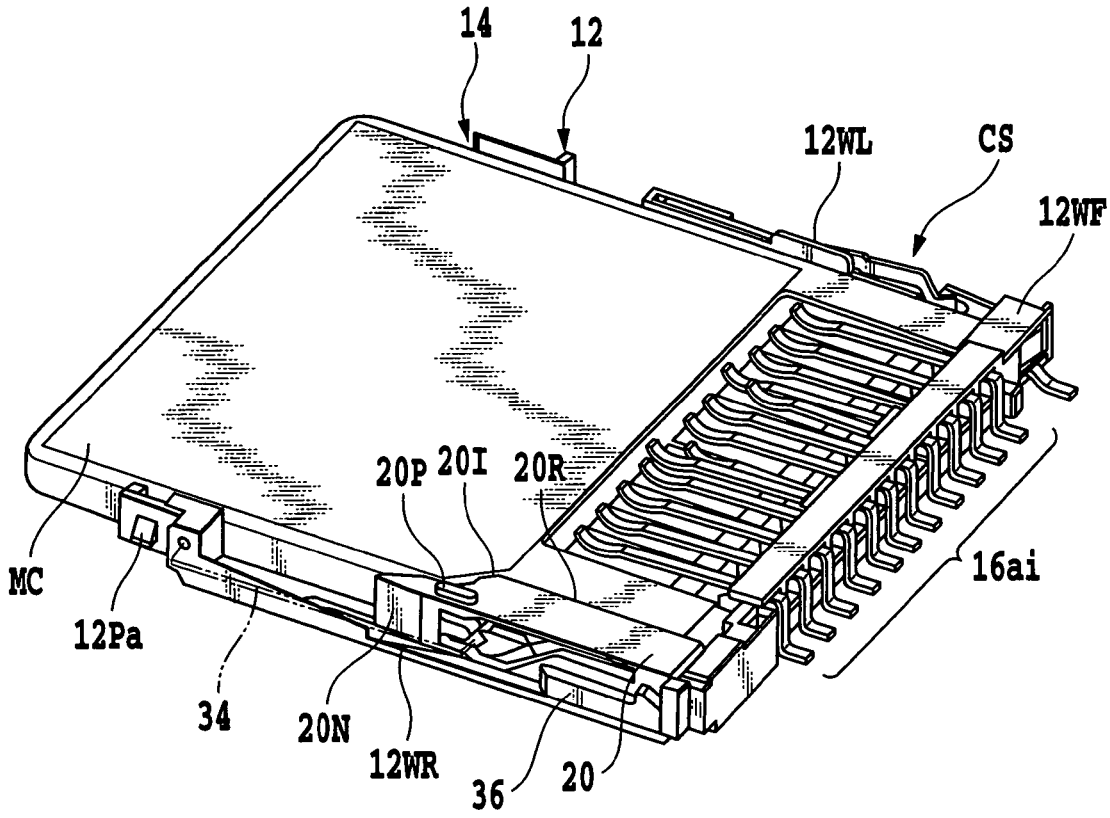
FIG. 5 is a perspective view of the aspect shown in FIG. 2 wherein a cover member is removed to illustrate a memory card.

As shown in FIG. 5, the accommodation portion 14 in the base member 12 opens on an upper side, part of a lower side (see FIG. 15) and at an end farther from a contact terminal fixing section described later. Accordingly, when the base member 12 is covered with the above-mentioned cover member 10, a card slot is formed at one end of the accommodation portion for inserting the memory card MC thereinto.

The base member 12 is molded in one piece, for example, by a resinous molding material. The base member 12 comprises side walls 12WR and 12WL for constituting opposite sides of the accommodation portion 14 in which the memory card MC is detachably accommodated and a contact terminal fixing wall 12WF on which is arranged contact terminals 16*ai* (i=1 to 11).

As shown in FIGS. 2 and 3, there are nibs 12Ra, 12Rb and 12Rc; and 12Rd, 12Re and 12Rf; on the outer surfaces of the side walls 12WR and 12WL, respectively.

Figure 15:
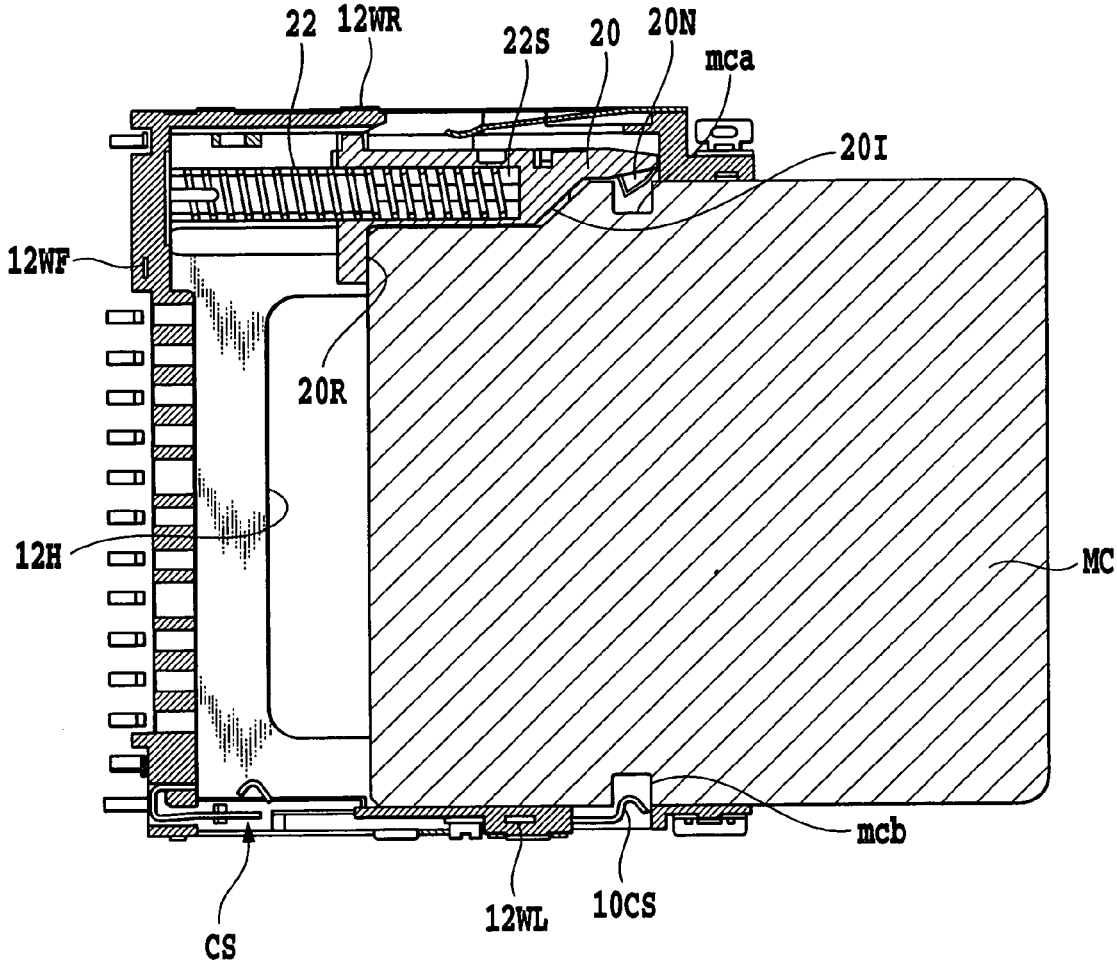
FIG. 15 is a side view of the aspect shown in FIG. 13.

On the bottom which is continuous with the side walls 12WR and 12WL, an open area 12H is formed at a generally center thereof, as shown in FIG. 15.

On the contact terminal fixing wall 12WF of the base member 12, a plurality of contact terminals 16*ai* (i=1 to 11) are provided. For example, eleven contact terminals 16*ai* are arranged at a predetermined mutual gap generally in parallel to the side walls 12WR and 12WL.

The contact terminal 16*ai* comprises a contact section having elasticity capable of being touched to be electrically connected to a contact pad of the memory card MC, a soldering terminal section to be soldered to an electrode section of the wiring board and electrically connected thereto, and a fixing section fixed to the base member 12, for coupling the contact section with the soldering terminal section. The fixing section of the contact terminal 16*ai* made, for example, of a thin metallic sheet such as spring phosphor bronze is fixed to the base member 12 by being press-fit into a groove not shown on the contact terminal fixing wall 12WF. The fixing section is press-fitted into the groove via a through-hole formed on the contact terminal fixing wall 12WF in the direction opposite to the inserting direction of the memory card MC.

On the inside of the side wall 12WR, an ejection mechanism is provided, for holding the memory card MC in the accommodation portion 14 and selectively ejecting the same from the accommodation portion 14.

As shown in FIGS. 5 and 15, the ejection mechanism comprises an ejector member 20 supported to be rockable in the widthwise direction thereof while moving relative to the base member 12, a coil spring 22 interposed between the inner circumference of the base member 12 and the ejector member 20 for biasing the ejector member 20 in the ejecting direction of the memory card MC, and an ejector member control section 24 for controlling the operation of selectively holding or releasing the ejector member 20 relative to the base member 12 in accordance with the loading/unloading operation of the memory card MC.

As illustrated in FIG. 15, one end of the nickel-plated coil spring 22 is supported by the inner circumference of the base member 12 and the other end thereof is coupled to a notch 22S in the ejector member 20.

The ejector member 20 is molded, for example, of resinous material and supported on the base member 12 to be slidable in the loading/unloading direction of the memory card MC. A pin 20P to be inserted into the elongate groove 10G of the cover member 10 is formed at an area of the ejector member 20 opposed to the upper surface of the cover member 10.

The ejector member 20 has a section to be engaged with the inserted memory card MC at a position opposite to the accommodation portion 14. As shown in FIG. 5, the section being engaged includes a card receiving section 20R for supporting a corner of a front end and a lateral side of the memory card MC, and an inclined surface section 20I which is continuous with the card receiving section 20R, for supporting an inclined surface section of the memory card MC. At a front end which is continuous with the inclined surface section 20I in formed a nib 20N engageable with the notch mca of the memory card MC.

Figure 10:
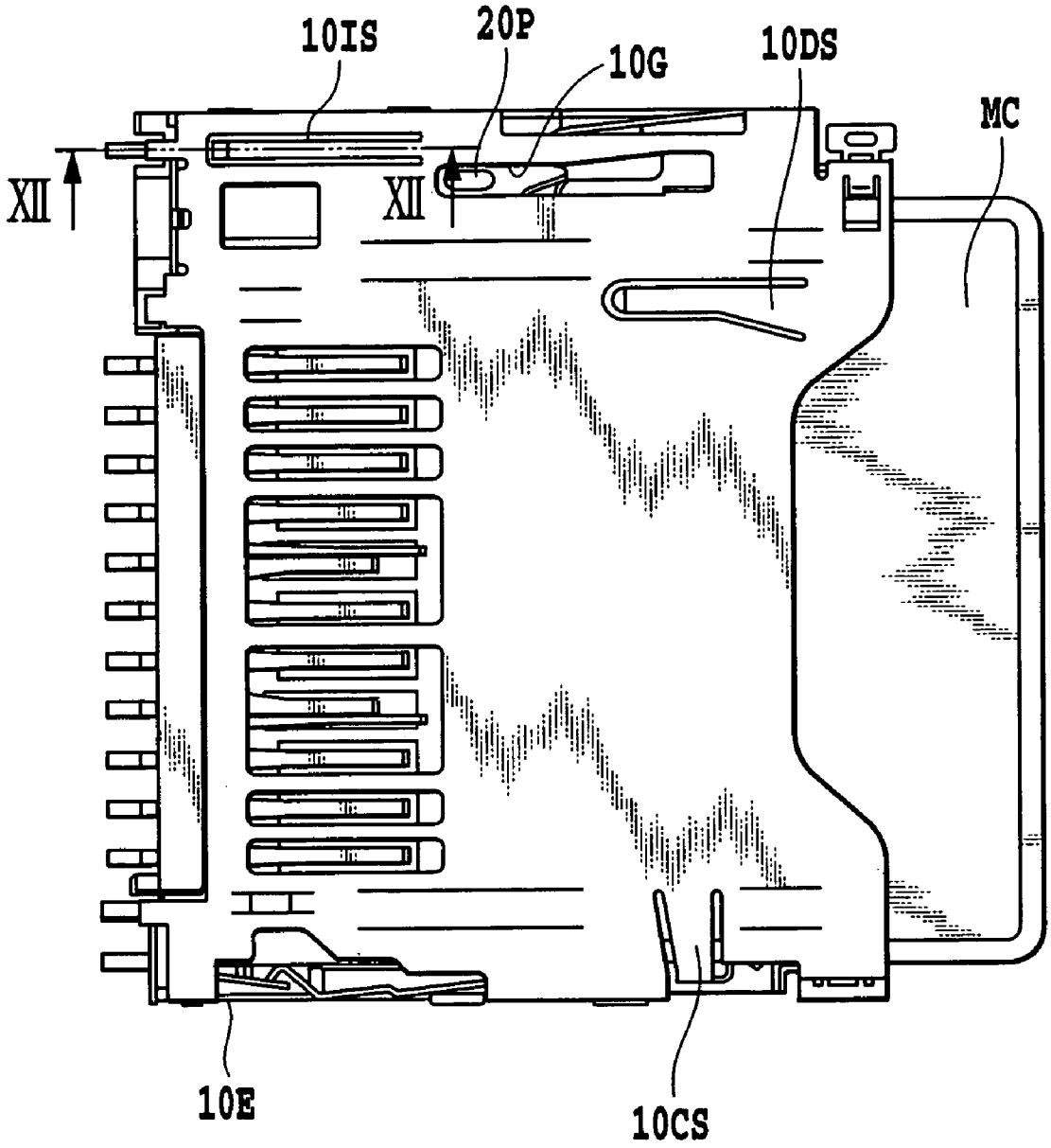
FIG. 10 is a plan view for explaining the operation of the aspect shown in FIG. 2.

Thereby, when the memory card MC is inserted into the accommodation portion 14, as shown in FIGS. 10 and 15, the pin 20P of the ejector member 20 moves along the elongate groove 10G and the nib 20N is made to rotate to be engaged with the notch mca of the memory card MC. On the other hand, when the memory card MC is ejected out from the accommodation portion 14, the pin 20P of the ejector member 20 moves along the elongate groove 10G and the nib 20N is made to rotate to be separable from the notch mca of the memory card MC, whereby if the memory card MC is forcibly pulled off from the ejector member 20, the memory card MC is taken out.

As shown in FIG. 1 in enlarged dimension, the ejector member control section 24 includes a cam element (a heart cam) 30 formed on the side wall 12WR of the ejector member 20, a lever guiding groove 32 comprising of a plurality of step height portions is formed around the heart cam 30, a cam lever 34 of a portal shape, the cam lever 34 having one end coupled to a hole of the side wall 12WR and the other end slidable along the lever guiding groove 32, and the elastic pressure spring 10L of the above-mentioned cover member 10 (see FIG. 3).

The elastic pressure spring 10L biases a bending front end of the cam lever 34 to a guide surface of the lever-guiding groove 32 in a slidable manner.

The resin-molded heart can 30 has, in a portion opposite to the nib 20N of the ejector member 20, a generally V-shaped cam surface 30*a* for selectively being engaged with one end of the cam lever 34 as shown in FIG. 1.

Figure 6:
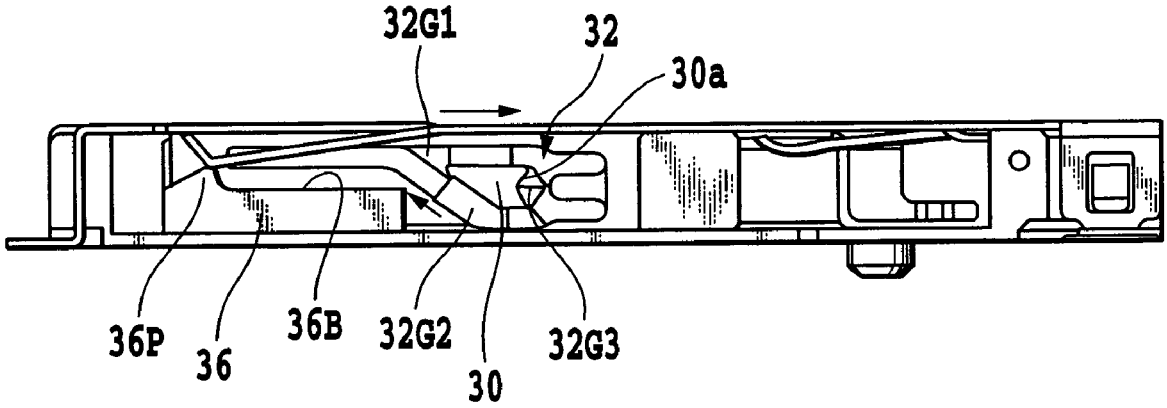
FIG. 6 is a partially sectional view of the aspect shown in FIG. 2 for explaining the operation thereof.

As shown in FIG. 6, the lever guiding groove 32 is formed of a first guiding groove 32G1 straightly extending along the side wall 12WR on one side of the heart cam 30, a second guiding groove 32G2 branched from the first guiding groove 32G1 to extend obliquely toward the side wall WR on the other side of the heart cam 30, after which extends in parallel to the first guiding groove 32G1, and a third guiding groove 32G3 for coupling a portion disposed between one end of the first guiding groove 32G1 and one end of the second guiding groove 32G2 and opposed to the cam surface 30*a*.

An average depth of the first guiding groove 32G1 is defined to be deeper than an average depth of the second guiding groove 32G2. A depth of the first guiding groove 32G1 in a portion intersecting one end of the second guiding groove 32G2 is defined to be deepest. Accordingly, a portion different in level is formed in the portion of the first guiding groove 32G1 intersecting the end of the second guiding groove 32G2.

Between one end of the third guiding groove 32G3 closer to an end of the first guiding groove 32G1 and the self same end of the first guiding groove 32G1, a depth of one end of the guiding groove 32G3 is defined to be deeper than a depth of the first guiding groove 32G1. Accordingly, a portion different in level is formed in a boundary area between the end of the third guiding groove 32G3 closer to the end of the first guiding groove 32G1 and the end of the first guiding groove 32G1.

Further, between one end of the third guiding groove 32G3 closer to an end of the second guiding groove 32G2 and the selfsame end of the second guiding groove 32G2, a depth of one end of the guiding groove 32G2 is defined to be deeper than a depth of the third guiding groove 32G3. Accordingly, a portion different in level is formed in a boundary area between the end of the third guiding groove 32G3 closer to the end of the second guiding groove 32G2 and the end of the second guiding groove 32G2.

Thereby, one end of the cam lever 34 is guided while following the operation of the ejector member 20 in the direction shown by an arrow in FIG. 6 sequentially through the first guiding groove 32G1,the third guiding groove 32G3 and the second guiding groove 32G2.

Further, as shown in FIG. 1 in enlarged dimension, a braking section 36 is formed as a movable part in an area adjacent to the lever guiding groove 32. As shown in FIGS. 5 and 6, the braking section 36 has a sliding-contact surface 36B into which is brought into sliding-contact the bending portion 10*sb* of the above-mentioned ejector member control piece 10IS in the cover member 10. At an end of the sliding-contact surface 36B in the ejector member 20 closer to the contact terminal fixing wall 12WF, there is a projection 36P over which climbs the bending portion 10*sb* of the ejector member control piece 10IS after it has once struck to the projection during the ejection of the memory card MC. A height of the projection 36P from the sliding-contact surface 36B to the uppermost end is set to be slightly lower than a distal end of the bending portion 10*sb* when the bending portion 10*sb* of the ejector member control piece 10IS strikes as shown by a chain doubled-dashed line in FIG. 12. Also, as shown in FIG. 1, the projection 36P has an inclined surface 36S to be brought into sliding-contact with the bending portion 10*sb* of the ejector member control piece 10IS after the latter has climbed over the projection 36P. The inclined surface 36S has a predetermined inclination so that the ejector member 20 is biased in the ejecting direction of the memory card MC by the bending portion 10*sb* of the ejector member control piece 10IS.

In addition, a card detecting switch CS for detecting the loading of the memory card MC into the accommodation portion 14 is provided in the side wall 12WL at a position closer to the contact terminal fixing wall 12WF.

Figure 8A:
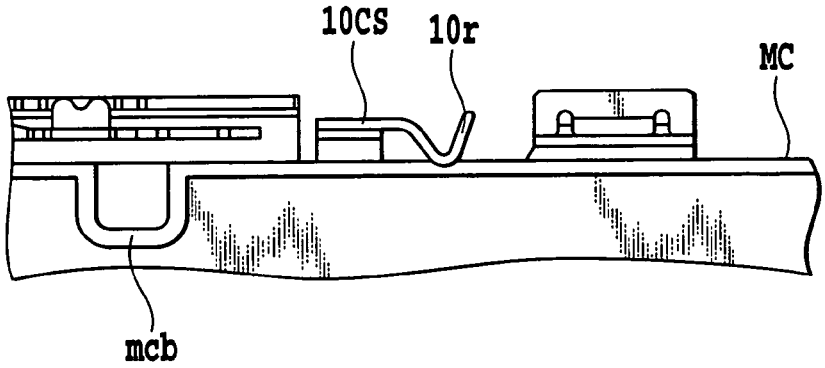
FIGS. 8A and 8B are partially sectional views, respectively, for explaining the operation of the aspect shown in FIG. 2.
Figure 11:
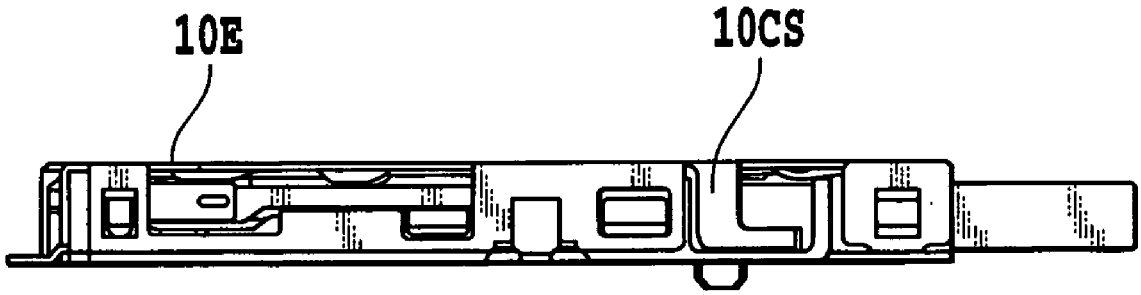
FIG. 11 is a side view of the aspect shown in FIG. 10.
Figure 12:
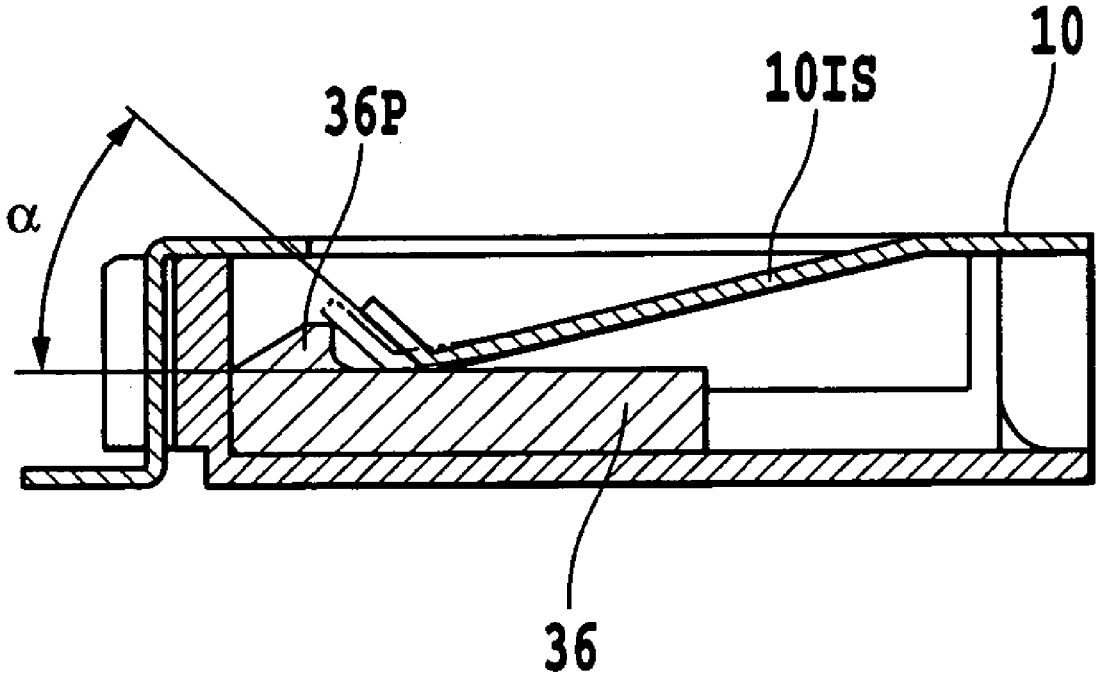
FIG. 12 is a partially sectional view of the aspect shown in FIG. 10 taken along a line XII—XII.

In such a structure, when a front end of the memory card MC is first inserted into the accommodation portion 14 through the card slot upon loading the memory card MC, the pin 20P of the ejector member 20 is in a wider area of the elongate groove 10G in the cover member 10 as shown in FIG. 2, and then moves to a narrower area thereof as shown in FIGS. 10, 11 and 12. Thereby, the nib 20N of the ejector member 20 is made to rotate and engages with the notch mca. As a result, the memory card MC is further advanced. At that time, the curved section 10*r* of the first braking piece 10CS is transferred from a state shown in FIG. 8A wherein it is in sliding-contact with a lateral surface of the memory card MC to a state shown in FIG. 8B wherein it is engaged with the notch mcb and then forcibly disengaged therefrom.

Subsequently, the memory card MC is further pressed together with the ejector member 20 against the biasing force of the coil spring 22, and when the pressure is released, one end of the cam lever 34 is released from the first guiding groove 30G1 and engaged with the cam surface 30*a* of the guiding groove 30G3 as shown in FIG. 1. At that time, a state is maintained wherein the nib 20N of the ejector member 20 is being engaged with the notch mca of the memory card MC. Accordingly, the ejector member control section 24 causes the ejector member 20 to be in a holding state. The memory card MC is held in the accommodation portion 14, and the contact pad of the memory card MC is brought into contact as well as electrically connected with the contact terminal 16*ai*. Also, the loaded memory card MC is prevented from unintentionally jumping out therefrom.

On the other hand, when the memory card MC is unloaded from the accommodation portion 14, first, the loaded memory card MC is furthermore slightly pushed in. At that time, one end of the cam lever 34 is released from the cam surface 30*a* by the forward motion of the ejector member 20, and transferred to the second guiding groove 32G2. Thereby, the pin 20P of the ejector member 20 is guided through the elongate groove 10G and retreated by the biasing force of the coil spring 22. Thus, the ejector member control section 24 causes the ejector member 20 to be in a released state.

At that time, the bending portion 10*sb* of the ejector member control piece once strikes to the projection 36P of the braking section 36 in the ejector member 20 as shown by a chain doubled-dashed line in FIG. 12, after which it climbs over a top of the projection 36P and is brought into sliding contact with the inclined surface 36S at a predetermined pressure as shown in FIG. 6.

Figure 8B:
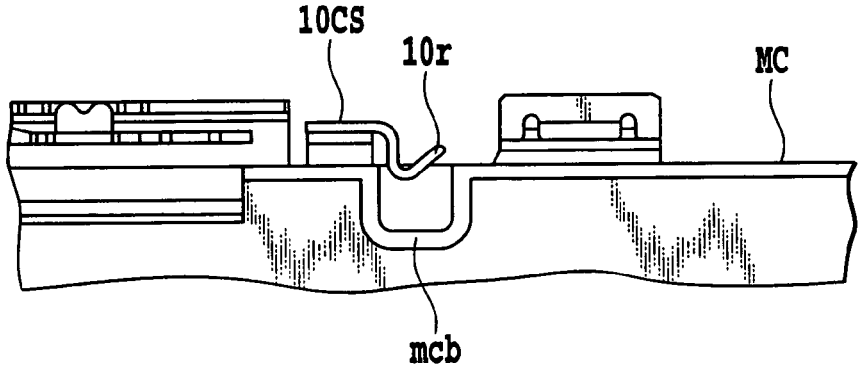
Figure 13:
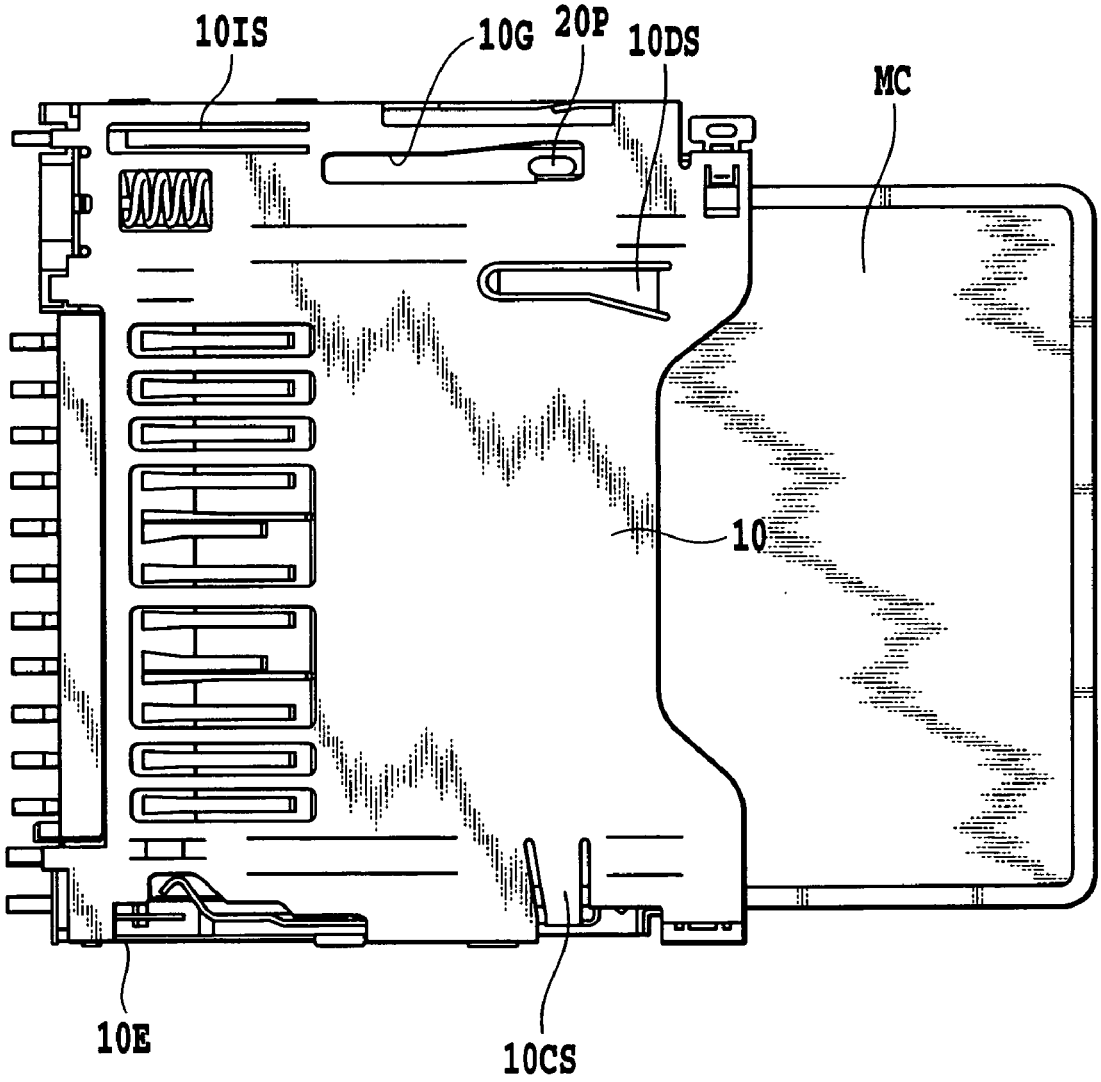
FIG. 13 is a plan view for explaining the operation of the aspect shown in FIG. 2.
Figure 14:
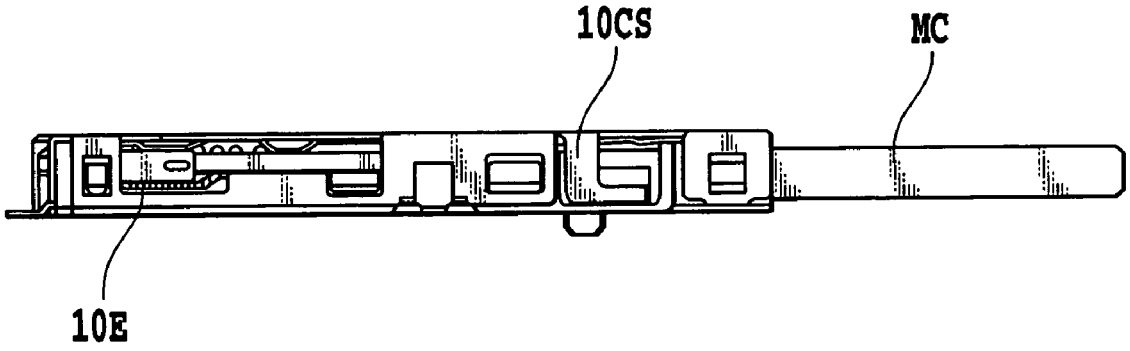
FIG. 14 is a side view of the aspect shown in FIG. 13.

Then, as shown in FIGS. 13 and 14, when the pin 20P of the ejector member 20 reaches the end of the elongate groove 10G, the nib 20N of the ejector member 20 is capable of being away from the notch mca of the memory card MC due to a rotational moment caused by the biasing force of the coil spring 22. At that time, the curved section 10*r* of the first braking piece 10CS is engaged with the notch mcb as shown in FIG. 8B.

And, the end of the memory card MC exposed outside is further pulled in the card ejecting direction, and the nib 20N of the ejector member 20 returns to a waiting position away from the notch mca of the memory card MC and free from the interference with the memory card MC. The curved section 10*r* of the first braking piece 10CS is also in a non-engaged state with the notch mcb.

Figure 9:
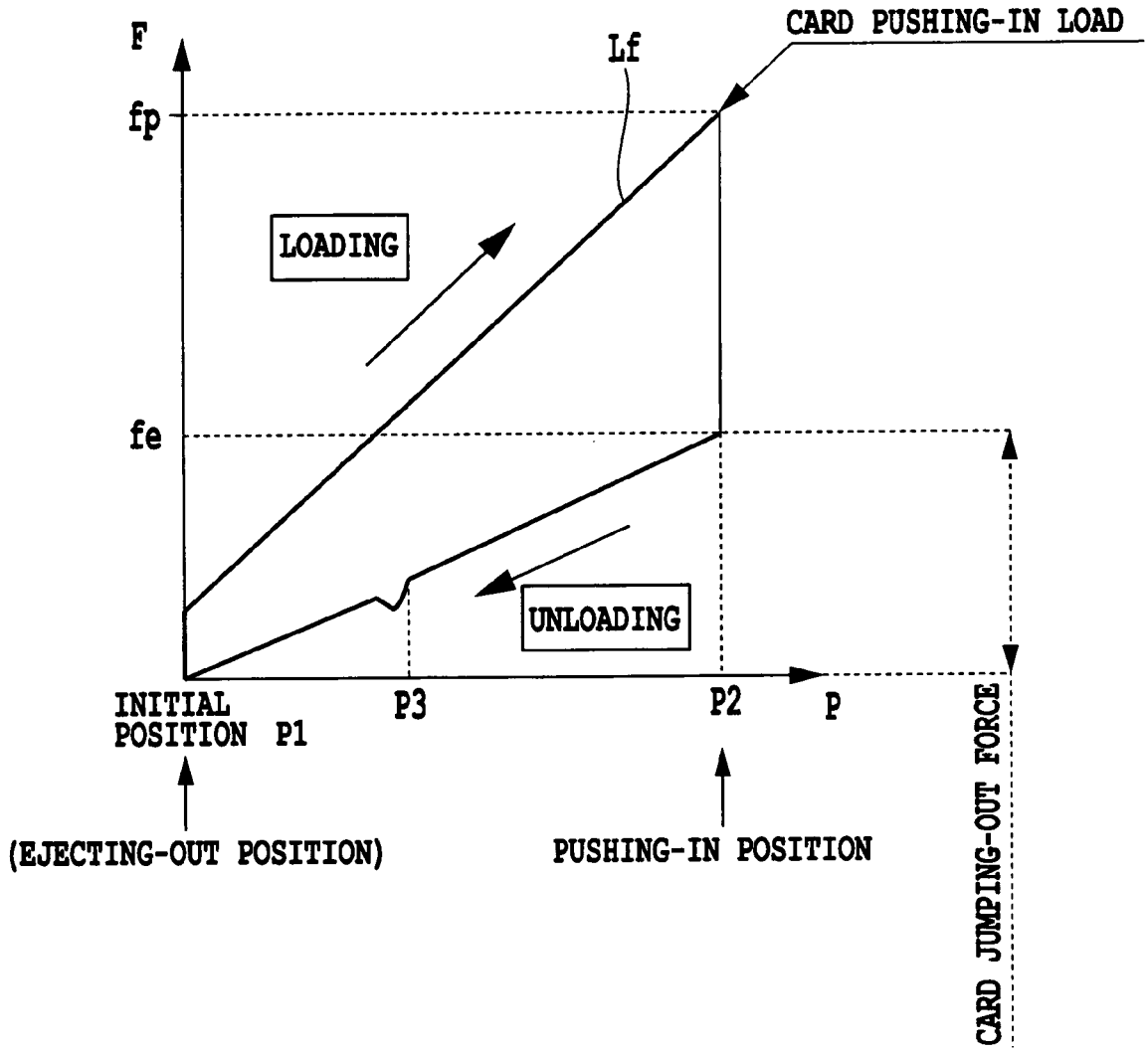
FIG. 9 is a characteristic curve of forces applied to the memory card when loaded and unloaded in the aspect shown in FIG. 2.

When the memory card MC is loaded or unloaded relative to the accommodation portion 14 as described above, a load F applied to the memory card MC varies, for example, in accordance with a characteristic curve Lf shown in FIG. 9. In this regard, in FIG. 9, a vertical axis represents a load F and a horizontal axis represents a position P of one end of the memory card MC in the loading/unloading direction, so that the relationship between the load F and the position P of the end of the memory card MC is shown on the characteristic curve Lf.

In FIG. 9, after a front end of the inserted memory card MC has been engaged with the section being engaged of the ejector member 20 at the initial position P1, the load F linearly increases at a predetermined inclination corresponding to the spring constant of the coil spring 22, and reaches the maximum value fp at a loaded position P2 at which the memory card MC is loaded. Then, when the memory card MC is furthermore pressed to release the ejector member 20, the ejector member 20 is being slightly away from the position P2 and the load F abruptly reduces by a predetermined amount to reach a value fe, after which the ejection of the memory card MC begins. The force of the value fe is used for jumping out the memory card MC from the accommodation portion 14. In this regard, the above-mentioned slight displacement of the ejector member 20 from the position P2 is as small as negligible on the characteristic curve Lf.

Subsequently, the ejector member 20 is further moved in the ejecting direction of the memory card MC by the biasing force (recovery force) of the coil spring 22 changing at a predetermined inclination, and at a position P3 at which the projection 36P of the braking section 36 in the ejector member 20 strikes to the bending portion 10*sb* of the ejector member control piece 10IS, the load F transiently reduces by a predetermined value, and thereafter continuously reduces at the predetermined inclination.

Accordingly, since the memory card MC is maintained in a state shown in FIG. 15 after the ejection speed of the ejector member 20 and the memory card MC is decelerated at the position P3, the undesirable jumping-out of the memory card MC is assuredly avoidable.

Figure 16:
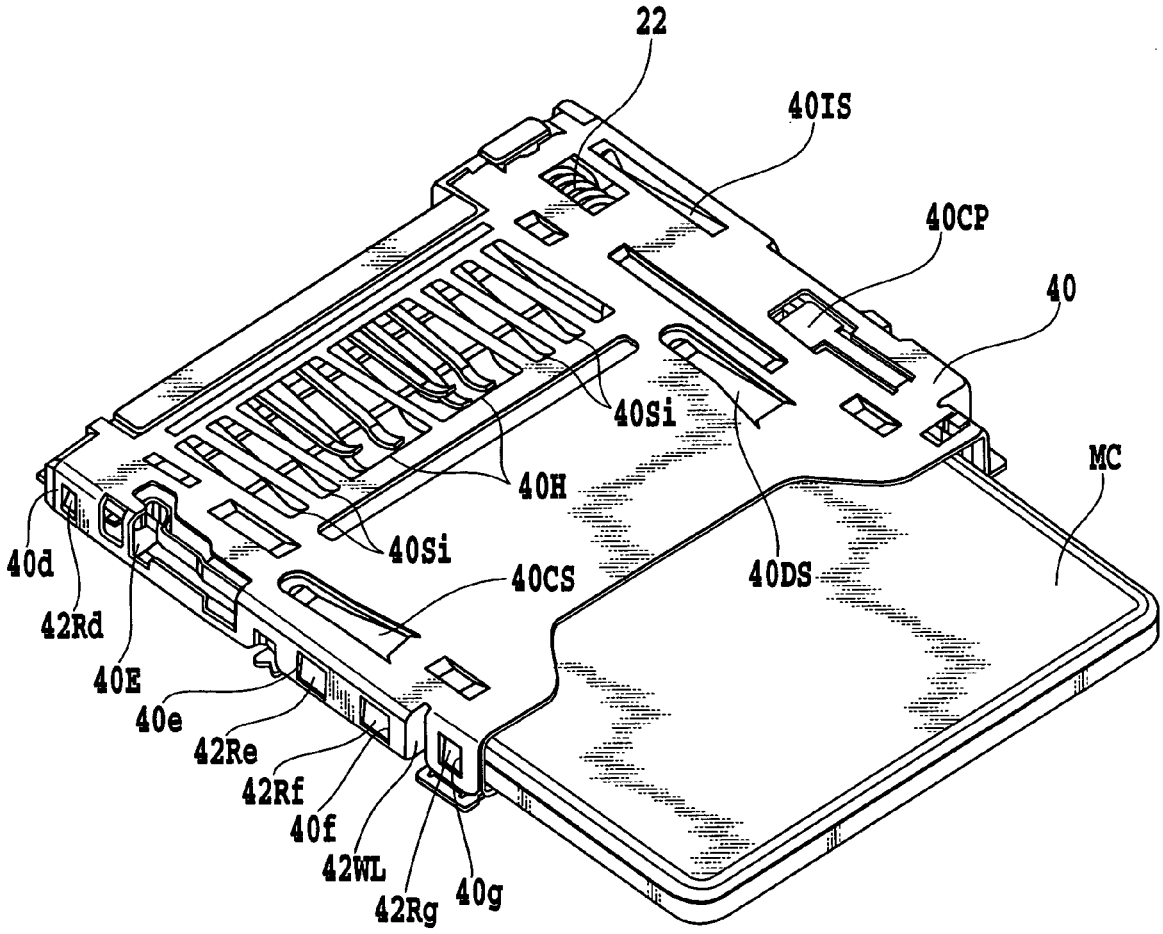
FIG. 16 is a perspective view illustrating a whole appearance of another aspect of the inventive IC card connector.
Figure 17:
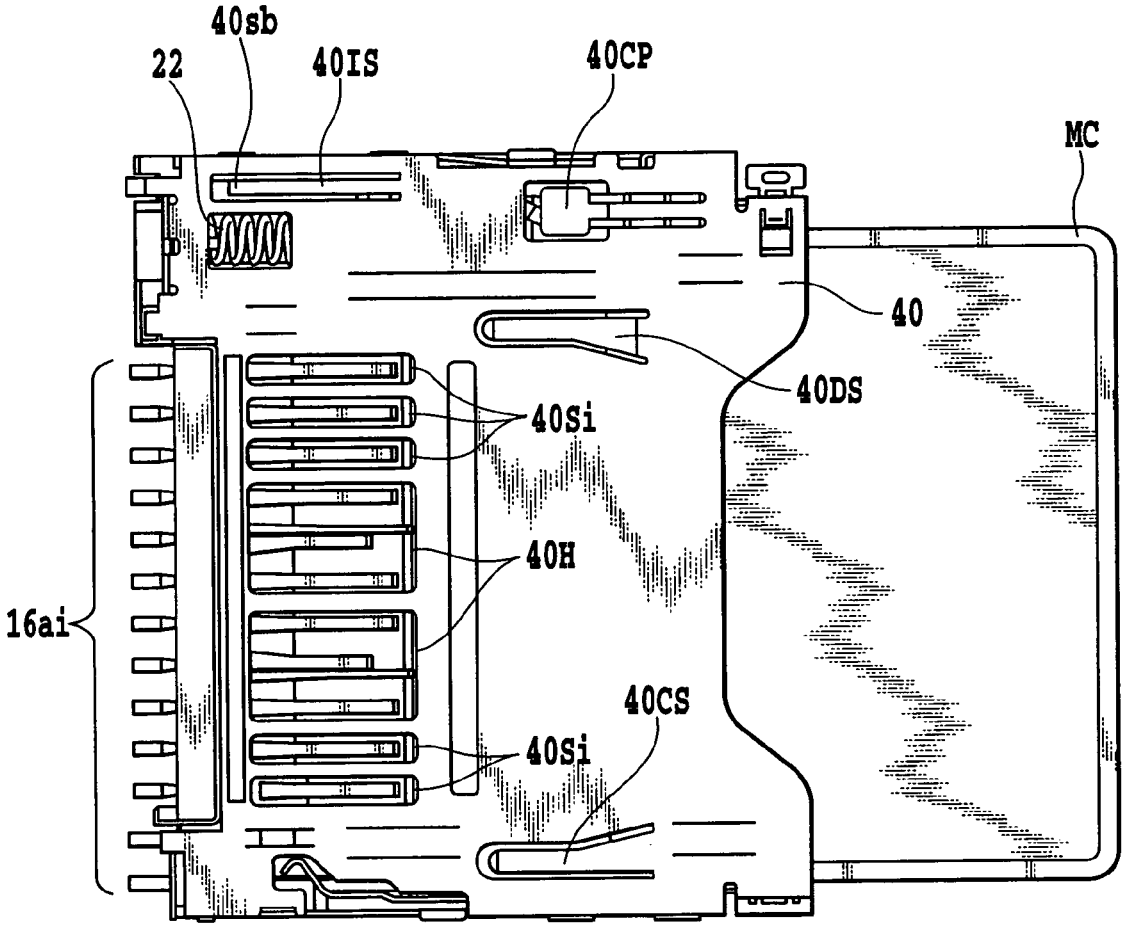
FIG. 17 is a plan view of the aspect shown in FIG. 16.

FIGS. 16 and 17 illustrate an appearance of another embodiment of the inventive IC card connector, respectively.

In the embodiment shown in FIG. 2, when the memory card MC is unloaded, the abrupt jumping-out of the memory card MC is avoided by the impingement of the bending portion 10*sb* of the ejector member control piece 10IS in the cover member 10 onto the projection 36P of the braking section 36 in the ejector member 20. On the other hand, in the embodiment shown in FIGS. 16 and 17, memory card improper insertion restriction means described later is provided in addition with such a structure as described above, for the purpose of avoiding the improper insertion of the memory card MC as well as preventing the abrupt jumping-out of the memory card MC when the improper insertion occurs.

In this regard, in the embodiment shown in FIGS. 16 and 17, the same reference numerals are used for denoting the same constituent elements as in FIG. 2 and the redundant explanation there of will be eliminated.

The IC card connector shown in FIG. 16 is adapted to connect an electrode section of the MC card MC detachably loaded in an accommodation portion in the direction shown by an arrow with a connector terminal section of a circuit board for the input/output of signals arranged in the interior of a predetermined electronic instrument.

The IC card connector includes a base member 42 on which are arranged a plurality of contact terminals or others for the electric connection with the memory card MC accommodated in the IC card connector and a cover member 40 forming an accommodation portion for the memory card MC in cooperation with the base member 42.

The cover member 40 having a gate-shaped cross-section is formed of a metallic sheet. There are engagement holes 40*a*, 40*b* and 40*c* on one of opposite lateral surfaces of the cover member 40 in correspondence to nibs of the base member 42 described later to be engaged with them. There are engagement holes 40*d*, 40*e*, 40*f* and 40*g* on the other lateral surface of the cover member 40 in correspondence to nibs of the base member 42 described later to be engaged with them.

In the vicinity of the engagement holes 40*a*, 40*e* and 40*g*, flange portions are provided in integral with each other to be soldered, for example, to the circuit board.

Accordingly, the cover member 40 is secured to the base member 42 by the engagement of the respective engagement holes 40*a* to 40*g* with the nibs of the base member 42.

Figure 18:
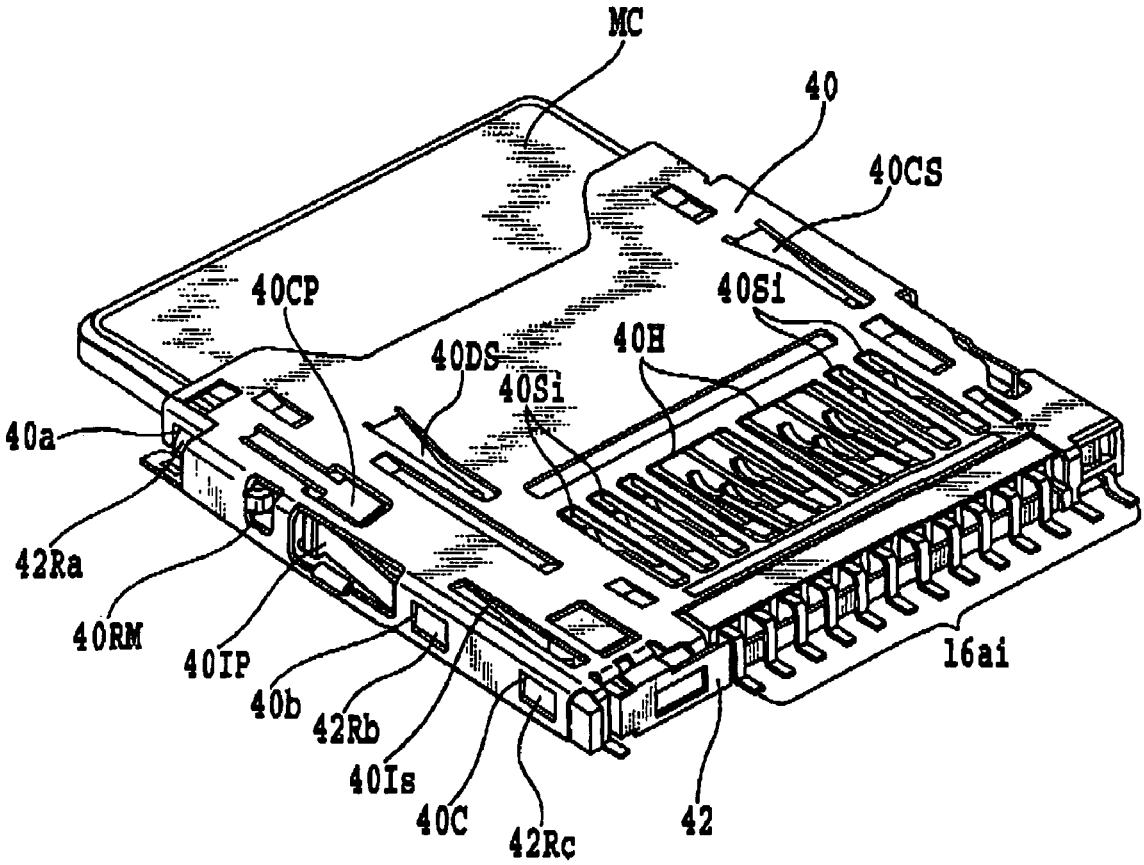
FIG. 18 is a perspective view illustrating a whole appearance of the aspect shown in FIG. 16 as seen in a different direction.
Figure 19:
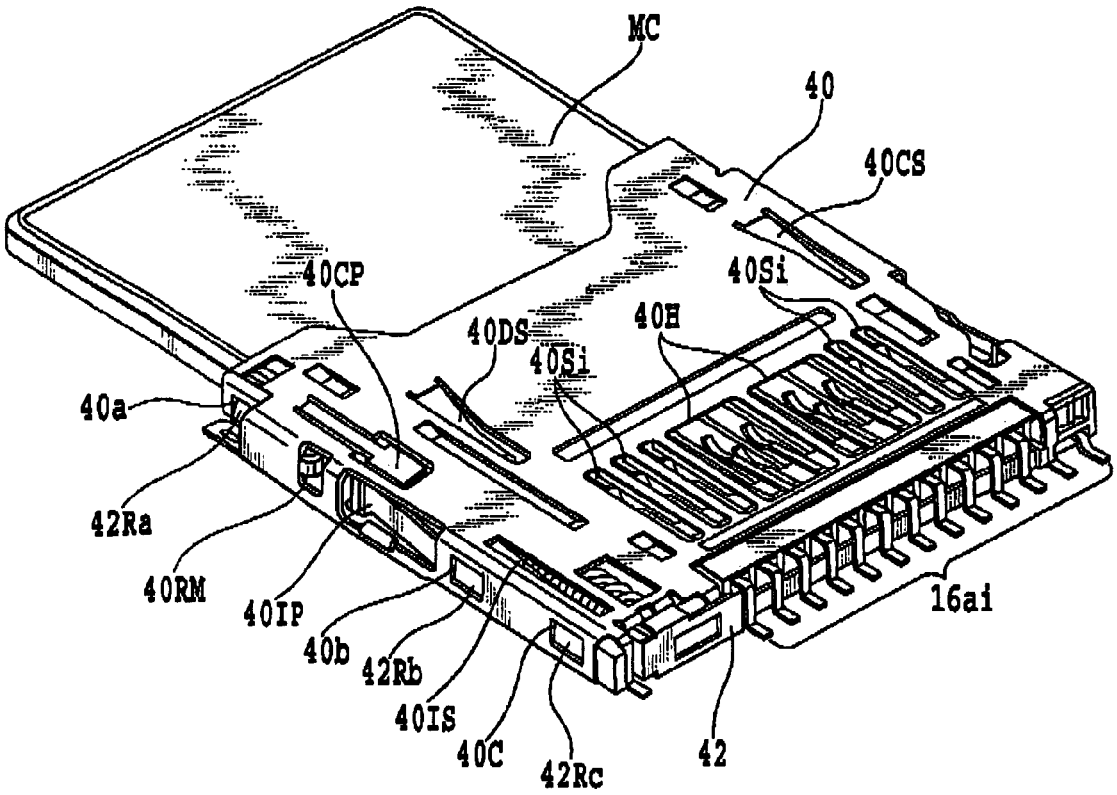
FIG. 19 is a perspective view illustrating a whole appearance of the aspect shown in FIG. 16 as seen in a further different direction.
Figure 20:
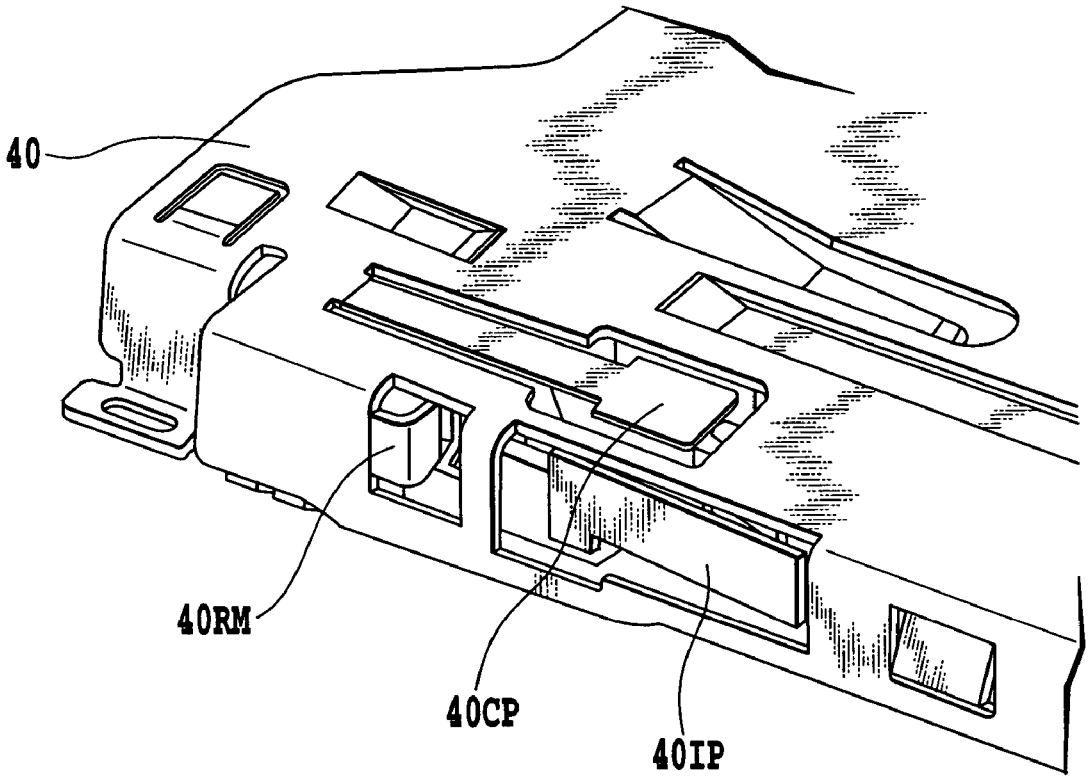
FIG. 20 is a partially enlarged perspective view of a main part of the aspect shown in FIG. 16.

Also, as shown in FIGS. 18 and 20, a pressure spring 40IP is provided between the engagement holes 40*a* and 40*b* on the one lateral surface of the cover member 40, for biasing, in a rotatable manner, a nib 50N of an ejector member 50 in an ejection mechanism described later toward the memory card MC inserted into the accommodation portion. A proximal end of the elastic pressure spring 40IP is integral with the cover member 40. Also, an opening is formed around the pressure spring 40IP on the lateral surface of the cover member 40.

Figure 24:
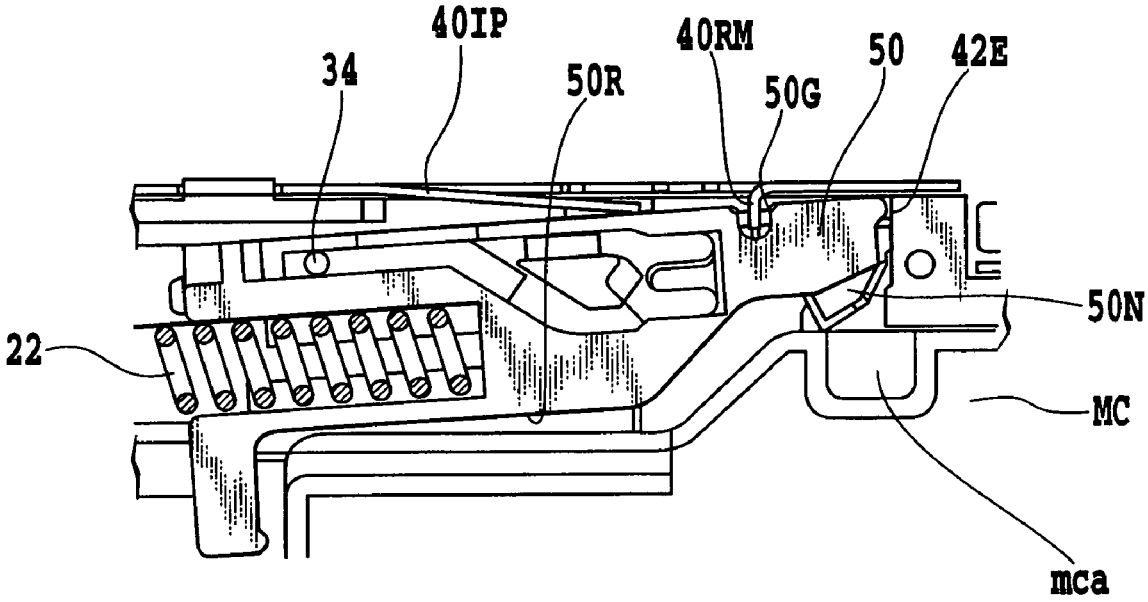
FIG. 24 is a partially sectional view for explaining the operation of the aspect shown in FIG. 16.

As shown in FIG. 18, a proximal end of an improper insertion restriction piece 40RM is integral with the cover member 40 at a position adjacent to the pressure spring 40IP. As shown in FIG. 20 in enlarged dimension, a distal end of the improper insertion restriction piece 40RM is bent in an L-shape toward an accommodation portion thereof, and selectively engaged with a recess 50G of the ejector member 50 described later as shown in FIG. 24. Thereby, the improper insertion restriction means is formed of the improper insertion restriction piece 40RM and the recess 50G of the ejector member 50.

A bending length at a front end of the improper insertion restriction piece 40RM is determined such that when the ejector member 50 is disposed in parallel to the lateral surface of the former, a position of the front end is in a plane generally parallel to the lateral surface including the front end of the pressure spring 40IP described above. Around the improper insertion restriction piece 40RM, an opening is provided.

As shown in FIG. 16, between the engagement holes 40*d* and 40*e* on the other lateral surface of the cover member 40, there is an opening 40E for communicating the interior and the exterior of the accommodation portion described above with each other.

As shown in FIG. 16, on the upper surface of the cover member 40 coupling the opposite lateral surfaces thereof, a plurality of slits 40Si and holes 40H are formed corresponding to a group of contact terminals described later. Also, an ejector member control piece 40IS is provided adjacent to the slits 40Si on the upper surface.

A proximal end of the elastic ejector member control piece 40IS is integral with the cover member 40 as shown in FIG. 16. The ejector member control piece 40IS is formed, for example, by punching part of the cover member 40 inward by the press working. Accordingly, in an area on the upper surface of the cover member 40 corresponding to the ejector member control piece 40IS, an opening is formed. The ejector member control piece 40IS has, at a distal end thereof, a bending portion 40*sb* described later selectively brought into contact with the ejector member. A distal end of the bending portion 40*sb* elastically displaceable toward the opening intersects a line parallel to the bottom surface of the base member 42, for example, at an angle $\alpha$ ($\alpha$=approximately 45±30 degrees). A shape of the distal end of the bending portion 40*sb* should not be limited thereto, but may be other shapes such as an arc or others.

A cam lever pressing piece 40CP for biasing one end of the cam lever 34 toward the guiding groove 54 of the ejector member 50 is provided generally on the same straight line as the ejector member control piece 40IS in the cover member 40. A proximal end of the elastic cam lever pressing piece 40CP is integral with the cover member 40. Also, on end of the cam lever pressing piece 40CP abuts to the cam lever 34.

Further, at a center of the upper surface thereof, a first braking piece 40CS and a second braking piece 40DS are provided generally in parallel to each other at a predetermined distance between the both, as shown in FIG. 16. Proximal ends of the first braking piece 40CS and the second braking piece 40DS are integral with the cover member 40. The first braking piece 40CS and the second braking piece 40DS are formed, for example, by punching out part of the cover member 40 inward by the press working. Accordingly, in areas on the upper surface of the cover member 40 corresponding to the first braking piece 40CS and the second braking piece 40DS, openings are formed. Each of the first braking piece 40CS and the second braking piece 40DS has a bending portion at a front end thereof to be selectively in slide-contact with the surface of the memory card MC.

Figure 22B:
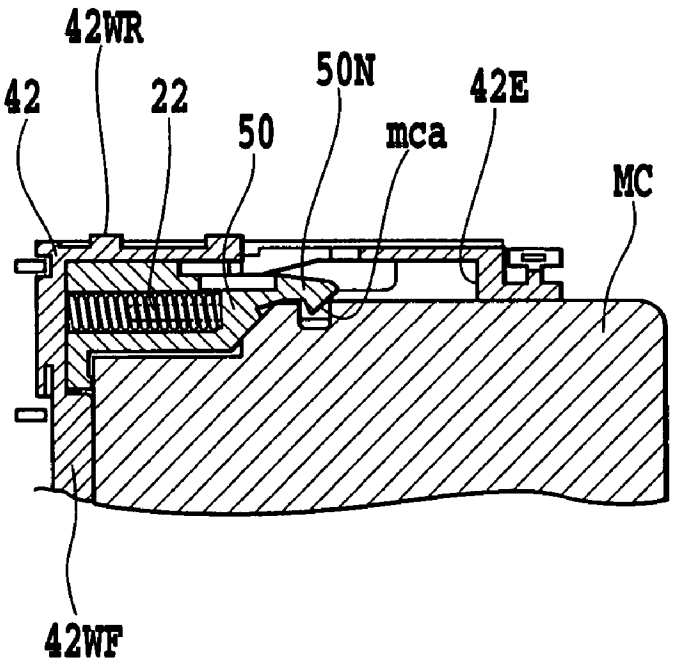
FIGS. 22A and 22B are partially sectional views, respectively, for explaining the operation of the aspect shown in FIG. 16.
Figure 22A:
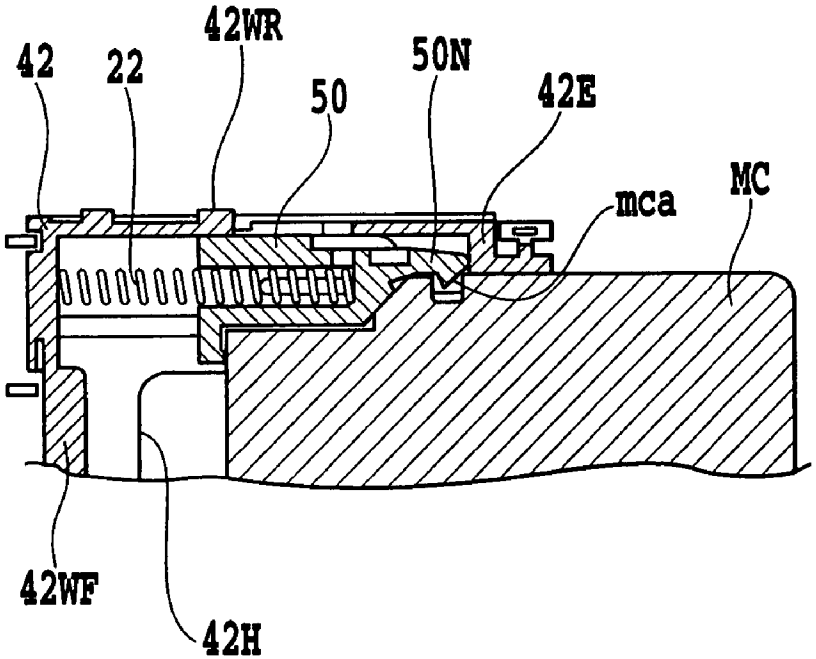

As shown in FIGS. 16 and 22A, the accommodation portion in the base member 42 opens on upper side, part of lower side and at an end opposite to a contact terminal fixing section described later. Accordingly, when the base member 42 is covered with the above-mentioned cover member 40, a card slot is formed at one end of the accommodation portion for inserting the memory card MC therein.

The base member 42 is molded as an integral body with resinous material. As shown in FIGS. 16, 22A and 22B, the base member 42 includes side walls 42WR and 42WL forming opposite sides of the accommodation portion for removably accommodating the memory card MC, and a contact terminal fixing wall 42WF in which are arranged the contact terminals 16*ai* (i=1 to 11).

As shown in FIGS. 16 and 18, there are nibs 42Ra, 42Rb and 42Rc, and 42Rd, 42Re, 42Rf and 42Rg on the outer surface of the side walls 42WR and 42WL, respectively.

As shown in FIG. 22A, there is an opening 42H generally in a central portion of the bottom consecutive to the side walls 42WR and 42WL.

A plurality of contact terminals 16*ai* (i=1 to 11) are provided in the contact terminal fixing wall 42WF of the base member 42. For example, the eleven contact terminals 16*ai* are arranged generally in parallel to each other at a predetermined pitch.

In an inner side portion of the side wall 42WR, an ejection mechanism is provided for holding the memory card MC in the accommodation portion and selectively ejecting the same from the accommodation portion.

Figure 23:
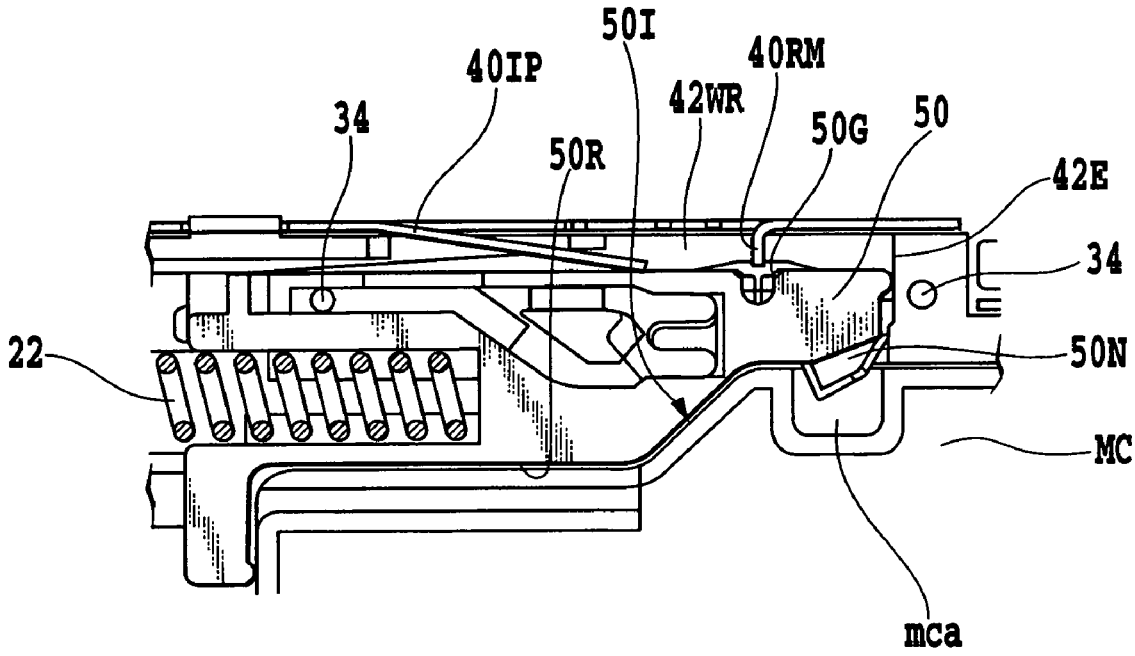
FIG. 23 is a partially sectional view for explaining the operation of the aspect shown in FIG. 16.

As shown in FIG. 23, the ejection mechanism includes an ejector member 50 supported to be swingable in the widthwise direction thereof while moving relative to the base member 42, a coil spring 22 interposed between the inner circumference of the base member 42 and the ejector member 50, for biasing the ejector member 50 in the unloading direction of the memory card MC, and an ejector member control section for selectively holding or releasing the ejector member 50 relative to the base member 42 in accordance with the loading/unloading operation of the memory card MC.

As shown in FIG. 15, one end of the nickel-plated coil spring 22 is supported by the inner circumference of the base member 42, and the other end of the coil spring 22 is coupled to the periphery of a recess 50*a* in the ejector member 50.

The ejector member 50 is molded, for example, with resinous material, and supported on the base member 42 to be slidable in the loading/unloading direction of the memory card MC. The ejector member has a pin (not shown) on the bottom surface thereof to be inserted into an elongate groove (not shown).

Figure 21:
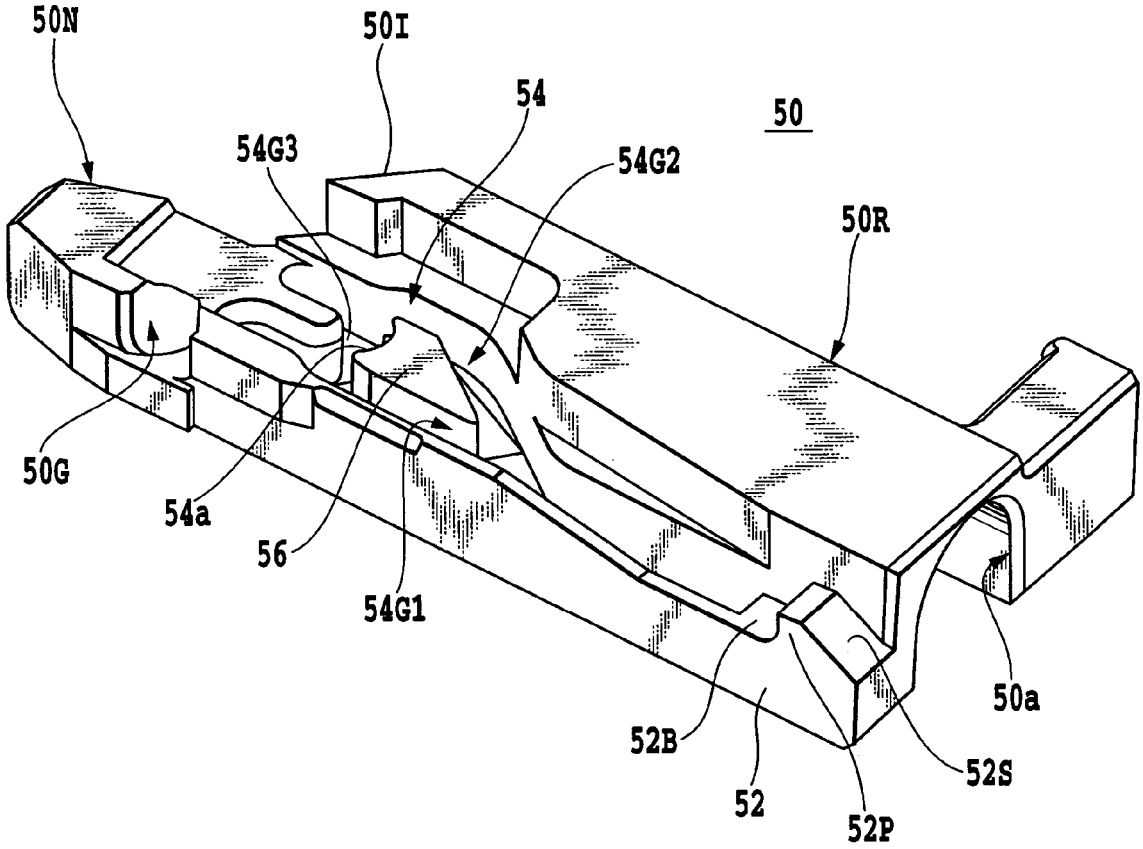
FIG. 21 is an enlarged perspective view of an ejector member used in the aspect shown in FIG. 16.

Also, as shown in FIG. 21 in enlarged dimension, the ejector member 50 has an engaged section to be engaged with the loaded memory card MC, disposed opposite to the accommodation portion. The engaged section includes a card-receiving section 50R for supporting a corner and a lateral surface of a front end portion of the memory card MC and an inclined surface section 50I consecutive to the card-receiving section 50R, for supporting an inclined surface of the card-receiving section 50R. At a distal end consecutive to the inclined surface section 50I, a nib 50N engageable with the notch mca of the memory card MC is formed.

Thereby, when the memory card MC is inserted into the accommodation portion, as shown in FIGS. 22A and 23, the pin (not shown) of the ejector member 50 moves along the elongate groove, whereby the nib 50N is made to rotate and engages with the notch mca of the memory card MC. On the other hand, when the memory card MC is unloaded from the accommodation portion, the pin of the ejector member 50 moves along the elongate groove, whereby the nib 50N is made to rotate and apart from the notch mca of the memory card MC. Thus, as shown in FIG. 24, by forcibly pulling out the memory card MC from the ejector member 50, the memory card MC is unloaded.

As shown in FIGS. 21 and 23, the ejector member control section includes a generally heart-shaped cam element (heart cam) 56 formed on a side of the ejector member 50 closer to the side wall 42WR, a lever guiding groove 54 formed around the heart cam 56, having a plurality of portions different in level, a stapler's needle-shaped cam lever 34, one end of which is coupled to a hole of the side wall 42WR and the other end slides along the lever guiding groove 54, the above-mentioned cam lever pressing piece 40CP (see FIG. 16) of the cover member 40.

The cam lever pressing piece 40CP biases a bending end of the cam lever 34 toward the guiding surface of the lever guiding groove 54 to be slidable therealong.

The heart cam 56 molded with resin has a generally V-shaped cam surface 54*a*, to which is selectively engaged one end of the cam lever 34.

The lever guiding groove 54 includes a first guiding groove 54G1 linearly extending along the side wall 42WR close to one side of the heart cam 56, a second guiding groove 54G2 extending obliquely while branched from the first guiding groove 54G1 close to the other side of the heart cam 56 and then extending parallel to the first guiding groove 54G1, and a third guiding groove 54G3 coupling a part between one end of the first guiding groove 54G1 and one end of the second guiding groove 54G2, opposed to the cam surface 54*a*.

An average depth of the first guiding groove 54G1 is defined to be deeper than an average depth of the second guiding groove 54G2. A depth of the first guiding groove 54G1 in a portion intersecting one end of the second guiding groove 54G2 is deepest. Accordingly, a portion different in level is formed in the first guiding groove 54G1 intersecting the one end of the second guiding groove 54G2.

Also, between one end of the third guiding groove 54G3 closer to the first guiding groove 54G1 and one end of the guiding groove 54G1, a depth of the end of the guiding groove 54G3 is defined to be deeper than a depth of the first guiding groove 54G1. Therefore, the difference in level occurs at the boundary between the end of the third guiding groove 54G3 closer to the end of the first guiding groove 54G1 and the end of the first guiding groove 54G1.

Further, between one end of the third guiding groove 54G3 closer to the second guiding groove 54G2 and one end of the guiding groove 54G2, a depth of the end of the guiding groove 54G2 is defined to be deeper than a depth of the third guiding groove 54G3. Therefore, the difference in level occurs at the boundary between the end of the third guiding groove 54G3 closer to the end of the second guiding groove 54G2 and the end of the guiding groove 54G2.

Accordingly, the end of the cam lever 34 is subsequently guided through the first guiding groove G1, the third guiding groove 54G3 and the second guiding groove 54G2 in the direction shown by an arrow in FIG. 23.

Further, as shown in FIG. 21 in enlarged dimension, a braking section 52 is formed as a movable part in an area adjacent to the lever guiding groove 54. The braking section 52 has a sliding surface 52B onto which slides a bending portion 40s of the ejector member control piece 40IS in the cover member 40. At an end of the sliding surface 52B of the ejector member 50 closer to the contact terminal fixing wall 42WF, a projection 52P is formed over which climbs a bending section 40*sb* of the ejector member control piece 40IS after it once abuts thereto. A height of the projection 52P from the sliding surface 52B to the uppermost end is defined to be slightly lower than a position of a front end of the bending section 40*sb* when the bending section 40*sb* abuts thereto. The projection 52P also has a inclined surface 52S on which slides the bending section 40*sb* of the ejector member control piece 40IS after it climbs over the projection 52P. The inclined surface 52S has a predetermined inclination so that the ejector member 50 is biased in the ejecting direction of the memory card MC by the bending section 40*sb* of the ejector member control piece 40IS.

A card detecting switch section is provided in the side wall 42WL at a position closer to the contact terminal fixing wall 42WF.

In such a structure, when a front end of the memory card MC is first inserted into the accommodation portion through the card slot upon loading the memory card MC, a pin (not shown) of the ejector member 50 moves from a wide section of the elongate groove in the base member 42 to a narrow section thereof. Thereby, as shown in FIG. 24, the nib 50N of the ejector member 50 is made to once rotate against the bias of the pressure spring 40IP, and then engages with the notch mca of the memory card MC, after which the memory card MC is furthermore made to advance as shown in FIG. 22A. At that time, there is no risk in that the nib 50N of the ejector member 50 is erroneously released from the notch mca since the nib 50N is pressed by the bias of the pressure spring 40IP.

Subsequently, as shown in FIG. 22B, the memory card MC is further pushed inward together with the ejector member 50 against the bias of the coil spring 22, and then released from the pushing force, upon which the end of the cam lever 34 is released from the first guiding groove 54G1 and engaged with the cam surface 54*a* of the third guiding groove 54G3. At that time, a state wherein the nib 50N of the ejector member 50 is engaged with the notch mca of the memory card MC is maintained.

Accordingly, as shown in FIGS. 18 and 22B, the ejector member control section maintains the ejector member 50. Thereby, the memory card MC is held in the accommodation portion and the contact pads of the memory card MC are brought into contact with the contact terminals 16*ai* to be electrically connected with each other. Also, the loaded memory card MC is prevented from undesirably jumping out.

Figure 25:
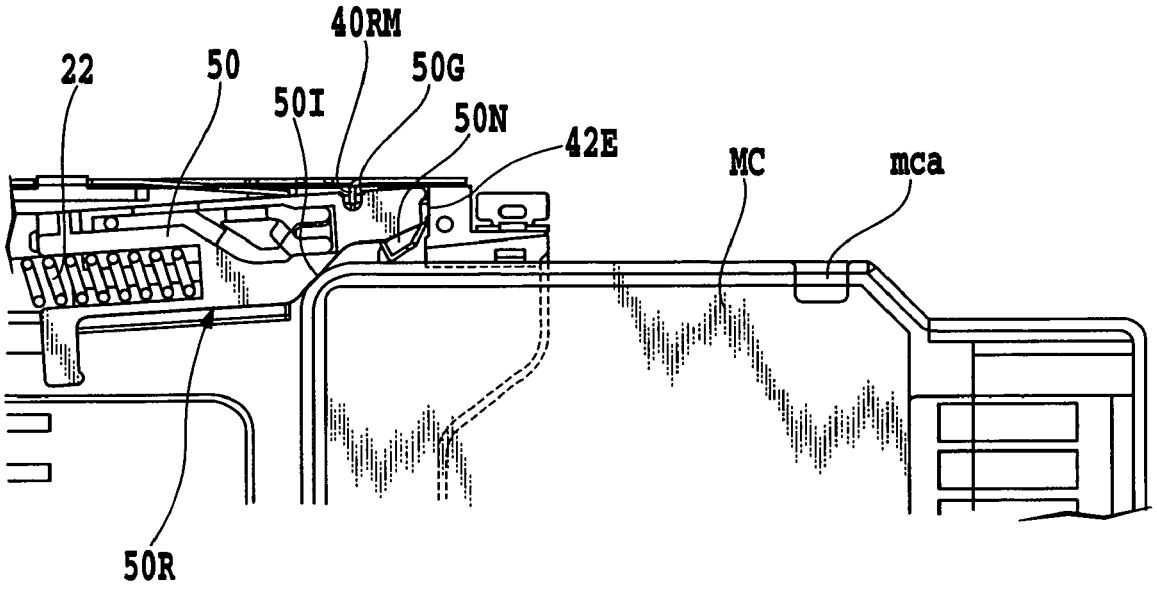
FIG. 25 is a partially sectional view for explaining the operation of the aspect shown in FIG. 16.

As shown in FIG. 25, if the memory card MC is erroneously inserted into the accommodation portion from a rear end thereof, the rear end pushes the inclined surface 50I to rotate the nib 50N of the ejector member 50 so that a front end of the improper insertion restriction piece 40RM is inserted into and engaged with the recess 50G of the ejector member 50. Thereby, a further insert of the memory card MC is avoided immediately after the memory card has been inserted. At that time, the abrupt jumping-out of the memory card MC is also avoidable because the coil spring 22 is hardly compressed. In this regard, if the memory card MC is erroneously inserted while opposing the electrode pads thereof to the base member 42, the further insert of the memory card MC is similarly avoidable immediately after the initial insert.

On the other hand, when the memory card MC is unloaded from the accommodation portion, first, the loaded memory card MC is slightly pushed therein. This causes the ejector member 50 to move forward whereby the end of the cam lever 34 is released from the cam surface 54*a* and transferred to the second guiding groove 54G2, whereby the pin of the ejector member 50 is guided to the elongate groove and retreated by the bias of the coil spring 22. Accordingly, the ejector member control section releases the ejector member 50.

At that time, the bending section 40*sb* of the ejector member control piece 40IS once strikes to the projection P of the braking section 52 in the ejector member 50, and thereafter, climbs over the peak of the projection 52P and slides on the inclined surface 52S at a predetermined pressure.

Next, when the pin of the ejector member 50 reaches the end of the elongate groove, the end surface of the nib 50N of the ejector member 50 is brought into contact with an endmost surface 42E of the base member 42, and the nib 50N of the ejector member 50 is capable of being away from the notch mca of the memory card MC by the rotational moment due to the bias of the coil spring 22. At that time, the nib 50N is pressed by the bias of the pressure spring piece 40IP immediately before being released from the notch mca of the memory card MC, whereby there is no risk in that the nib is undesirably released from the notch mca of the memory card MC.

As shown in FIG. 24, when the exposed end of the memory card MC is further pulled in the card-unloading direction, the nib 50N of the ejector member 50 is made to rotate and returns to a waiting position that is away from the notch mca of the memory card MC and does not interfere with the memory card MC. At that time, a front end of the improper insertion restriction piece 40RM is inserted into the recess 50G of the ejector member 50. And, the nib 50N of the ejector member 50 is pushed back to the original state due to the biasing force of the pressure spring 40IP.

Figure 26A:
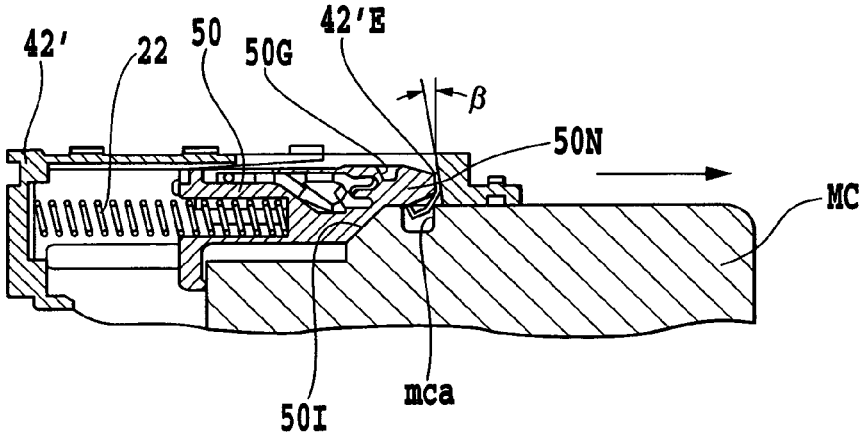
FIGS. 26A and 26B are partially sectional views, respectively, of a modification of a base member for explaining the operation of the aspect shown in FIG. 16.
Figure 26B:
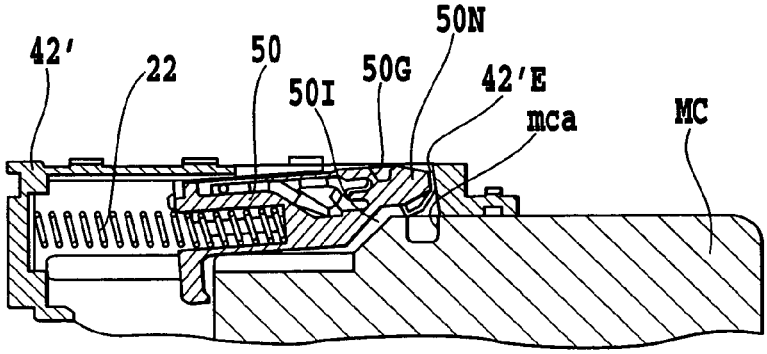

In this regard, while the endmost surface 42E of the base member 42 is formed generally perpendicular to the side wall thereof in the above-mentioned embodiment, the present invention should not be limited thereto but may be such that the endmost surface 42'E of the base member 42' is inclined to a surface perpendicular to the side wall at a predetermined angle β, for example, approximately 8 degrees, as shown in FIGS. 26A and 26B.

In such a case, as shown in FIG. 26A, when the pin of the ejector member 50 reaches the end of the elongate groove, the end surface of the nib 50N of the ejector member 50 moving in the direction shown by an arrow abuts to the endmost surface 42'E of the base member 42'. Thus, the nib 50N of the ejector member 50 is in a state capable of being away from the notch mca of the memory card MC due to the rotational moment caused by the bias of the coil spring 22, and if the exposed end of the memory card MC is further pulled in the unloading direction of the card, a tapered triangular shaped front end surface of the nib 50N in the ejector member 50 conforms to the endmost surface 42'E as shown in FIG. 26B, whereby the nib 50N is more easily made to rotate away from the notch mca of the memory card MC to a waiting position free from the interference with the memory card MC.

The present invention has been described in detail with respect to the preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An Integrated Circuit (IC) card connector comprising:

a housing member having an accommodation portion for selectively accommodating ah IC card therein and contact terminals to be electrically connected to said IC card;

an ejection mechanism for selectively ejecting said IC card outward from said accommodation portion;

a plurality of braking pieces for braking the ejection of said IC card in a state wherein said IC card is ejected from said accommodation portion of said housing member by said ejection mechanism; and improper insertion restriction means for restricting the inserting operation of said IC card when said IC card is inserted to said accommodation portion in the abnormal state different from the proper state;

wherein when said IC card is ejected by said ejection mechanism, an end of at least one of the plurality of braking pieces retreats after contacting a movable part of said ejection mechanism.

2. An IC card connector as claimed in claim 1, wherein said improper insertion restriction means comprises an improper insertion restriction piece provided in said housing member, and a recess provided in said ejector member in correspondence to one end of said improper insertion restriction piece so that said end of said improper insertion restriction piece selectively engages therewith.

3. An IC card connector as claimed in claim 2, wherein said housing member has a spring piece for biasing said ejector member toward a side of said accommodation portion.

4. IC card connector as claimed in claim 2, wherein said housing member has an endmost surface with which the end surface of the nib of said ejector member is brought into contact.

5. An IC card connector as claimed in claim 4, wherein said endmost surface is inclined to a surface perpendicular to the side wall surface of said housing member at a predetermined angle.

* * * * *

UNITED STATES PATENT AND TRADEMARK OFFICE

CERTIFICATE OF CORRECTION

PATENT NO. : 7,108,557 B2
APPLICATION NO. : 11/081662
DATED : September 19, 2006
INVENTOR(S) : Kouji Kikuchi et al.

It is certified that error appears in the above-identified patent and that said Letters Patent is hereby corrected as shown below:

Claim 1, column 15, line 19, “ah” should read --an--.

Claim 4, column 16, line 20, “IC” should read --An IC--.

Signed and Sealed this

Thirtieth Day of January, 2007

JON W. DUDAS
*Director of the United States Patent and Trademark Office*